US006461233B1

(12) United States Patent
Gilkison et al.

(10) Patent No.: US 6,461,233 B1
(45) Date of Patent: Oct. 8, 2002

(54) LOW AIR VOLUME LABORATORY FUME HOOD

(75) Inventors: Kevin C. Gilkison, Overland Park, KS (US); Larry G. Hambleton, Olathe, KS (US); Gary P. Roepke, Kansas City, MO (US); Yu Rich Ma, Overland Park, KS (US); Kermit W. Dyer, Overland Park, KS (US)

(73) Assignee: Labconco Corporation, Kansas City, MO (US)

( * ) Notice: Subject to any disclaimer, the term of this patent is extended or adjusted under 35 U.S.C. 154(b) by 0 days.

(21) Appl. No.: 09/932,142

(22) Filed: Aug. 17, 2001

(51) Int. Cl.[7] ..... B08B 15/02
(52) U.S. Cl. ..... 454/57; 454/56
(58) Field of Search ..... 454/56, 57, 61, 454/62

(56) References Cited

U.S. PATENT DOCUMENTS

| | | | | |
|---|---|---|---|---|
| 2,715,359 A | * | 8/1955 | Mackintosh et al. | 126/21 A |
| 3,049,069 A | * | 8/1962 | Whiston et al. | 454/56 |
| 3,747,505 A | * | 7/1973 | Turko | 454/59 |
| 4,177,718 A | * | 12/1979 | Grow et al. | 422/104 |
| 4,434,711 A | * | 3/1984 | Zboralski et al. | 454/62 |
| 4,534,281 A | | 8/1985 | Parks et al. | |
| 4,632,022 A | * | 12/1986 | Baitinger et al. | 312/209 |
| 4,856,420 A | * | 8/1989 | Problete et al. | 312/138.1 |
| 4,934,256 A | | 6/1990 | Moss et al. | |
| 4,996,910 A | * | 3/1991 | Howorth | 454/57 |
| 5,447,468 A | | 9/1995 | Tener et al. | |
| 5,569,357 A | | 10/1996 | Kuhn et al. | |
| 5,620,561 A | | 4/1997 | Kuhn et al. | |
| 5,697,838 A | | 12/1997 | Morris | |
| 5,716,267 A | | 2/1998 | Hambleton et al. | |
| 5,797,790 A | * | 8/1998 | Rindoks et al. | 454/59 |
| 5,851,143 A | * | 12/1998 | Hamid | 312/223.6 |

FOREIGN PATENT DOCUMENTS

| | | | | |
|---|---|---|---|---|
| DE | 3939063 A | * | 5/1991 | B01L/1/00 |
| GB | 923970 A | * | 6/1960 | B01L/1/00 |
| JP | 362266345 A | * | 1/1987 | B01L/1/00 |

* cited by examiner

*Primary Examiner*—Derek Boles
(74) *Attorney, Agent, or Firm*—J. David Wharton; Stinson Morrison Hecker LLP

(57) ABSTRACT

A low air volume exhaust hood is based on the concept of zone laminar flow through the hood as the hood sash is raised to different levels. Laminar flow is achieved through a plurality of plenum zones constructed at the rear of the cabinet. Preferably the zones are created by utilizing different sized openings in a rear baffle of the cabinet which presents the plenum chamber. Alternatively, distinct independent plenums may be formed and coupled with a common exhaust structure. By utilizing laminar flow which is directed through different zones corresponding to different open positions of the sash, a lower volume of air can be moved through the hood while achieving desired levels of evacuation. Performance of the hood is further enhanced by a novel air foil design at the floor of the hood which promotes a sweeping flow of air across the floor. Turbulent flow is further reduced by a sash handle design which allows air to flow beneath the terminal edge of the sash at the same velocity as air entering the hood through the primary sash opening. A directional baffle for bypass air moving down the inside of the sash helps to control air flow in the upper portion of the hood.

69 Claims, 9 Drawing Sheets

LOW AIR VOLUME LABORATORY FUME HOOD

STATEMENT REGARDING FEDERALLY SPONSORED RESEARCH OR DEVELOPMENT

Not Applicable.

CROSS-REFERENCE TO RELATED APPLICATIONS

Not Applicable.

BACKGROUND OF THE INVENTION

This invention relates to laboratory work cabinets. More specifically, this invention relates to laboratory work cabinets which provide improved exhaust containment such that the cabinets may be operated at lower inflow air velocities than traditional work cabinets, thereby reducing the energy required to condition the exhausted air.

Laboratory work cabinets, or "fume hoods", are ventilated enclosures where undesirable and dangerous fumes or vapors are captured, contained and removed. These fumes or vapors are prevented from escaping into the external laboratory environment and, instead, are diluted with room air and exhausted through the hood's exhaust system where they can be adequately dispersed. This capture and containment is accomplished by controlling gas and vapor contaminants present in the hood work area and directing them away from the user.

Fume hoods known in the prior art generally comprise a cabinet which defines an enclosed work area. The cabinet has an opening in the front face thereof for providing access to the work area and typically includes a panel or sash which is movable between open and closed positions to provide selective access to the work area. The sash is movable between various heights to accommodate positioning of hands and arms in the work area. Prior art fume hoods typically include an exhaust system, often connected to the top of the cabinet, for venting fumes that collect in the work area of the cabinet.

Air flow into prior art fume hoods, or "exhaust hoods", typically is achieved by an exhaust blower which "pulls" air from the external laboratory environment into and through the hood and its associated exhaust system. Thus, contaminants are drawn away from the operator. This pull of air into the hood is measured as face velocity. It is, of course, essential to provide an adequate face velocity for any laboratory fume hood so as to ensure containment of the fumes or other contaminants and to ensure that these contaminants will ultimately be removed through the exhaust system. The face velocity, however, must not be so high that it creates turbulent conditions within the hood which can lead to the escape of contaminants. Accordingly, it is desirable that the face velocity be maintained nearly constant, not varying appreciably throughout the normal working range of the sash. Since raising of the sash increases the effective size of the exhaust hood opening, the volume of air pulled through the face opening of the hood must be increased in order to maintain a constant face velocity as the sash is raised. For most materials that are handled in fume hoods, a face velocity of approximately 100 feet per minute (fpm) is satisfactory.

Fume hoods known in the prior art often incorporate a bypass opening located in the front face of the cabinet above the opening into the work area, or located in the top face of the cabinet in the area at or near the front face. Bypass hoods are designed so that as the sash is moved toward a closed position, air which normally enters the hood through the sash opening is redirected through the bypass opening thus reducing fluctuations in face velocity as the position of the sash is varied. Therefore, the possibility that the velocity will reach a level that would be detrimental to the procedures being performed in the work area, or to those persons in the vicinity of the work area, is reduced.

Bypass hoods are not without weaknesses, however. For instance, the angle at which bypass air enters the work area changes with sash position and the face velocity may increase to as much as three times the normal face velocity as the sash moves toward the closed position even though air is being directed through the bypass opening.

Additionally, prior art fume hoods, including bypass hoods, exhibit characteristic internal vortex air flows known as "a roll" in which a portion of the incoming air flow rolls up the interior side of the rear face and down the interior side of the sash. Fumes generated within the hood from laboratory procedures often are entrained into the roll resulting in an increase in the concentration of contaminants throughout the work area. Specifically, this tendency for contaminated air to roll forward produces high concentrations of contaminants in the area directly behind the sash increasing the opportunity for leakage at the sash handle.

A primary factor in creating this undesirable air flow is that traditional fume hoods are unable to remove contaminants from the work area as quickly as they are generated, i.e., contaminants are not removed on the "first pass". Rather, fumes generated by laboratory procedures freely mix with incoming air, circulate in the vortex and come back down the interior surface of the sash. This raises the parts per million concentration of the contaminant throughout the work area.

A further weakness of prior art fume hoods is that air flow within the hood interior varies with the position of the sash making it difficult to idealize conditions for optimum containment. Still further, bypass air, while beneficial to maintaining a constant face velocity, continuously varies with sash position, both in volume and direction, as influenced by the changing internal conditions. This makes the hood less robust in its ability to contain contaminants. Additionally, while traditional and bypass fume hoods effectively contain contamination behind the vertical plane of the sash, they are susceptible to external conditions, traffic patterns near the sash opening and work procedures, as contaminants are concentrated directly behind the plane of the sash and under the sash handle. Another weakness of prior art fume hoods is their susceptibility to lead around the front sash foil. Existing air foils are not designed to provide uniform velocities both with and without a person standing in front of the hood.

Because of the afore-described deficiencies, typical prior art fume hoods are designed to provide a certain excess air flow so that even during more optimal operating conditions there will be adequate air flow to satisfy safe operating conditions. This design criteria results in significant energy loss both through exhaust system power requirements and by removing conditioned air from the building which must be replaced by other conditioned air.

Accordingly, there remains a need for a laboratory work cabinet which more effectively contains contaminated air and is less susceptible to external conditions such as traffic patterns near the sash opening or air fluctuations caused by work procedures. Further, there remains a need for a laboratory work cabinet which substantially removes contaminants from the work area as quickly as they are generated. Still further, there remains a need in the fume hood industry for a laboratory work cabinet which operates at lower inflow air velocities than traditional hoods thereby reducing the energy required to operate the exhaust system and reducing the demand on the building HVAC system.

SUMMARY OF THE INVENTION

Accordingly, in one of its aspects, the present invention provides a laboratory fume hood which more effectively contains contaminated air and is less susceptible to external conditions.

In another of its aspects, the present invention provides an exhaust hood in which fumes are contained deeper into the interior of the hood reducing contaminant concentrations directly behind the plane of the sash.

In yet another aspects, the present invention provides an exhaust hood which operates at lower inflow air velocities than traditional hoods thereby reducing the energy required to exhaust air at acceptably low contaminant concentrations and reducing the demand on the HVAC system.

In another of its aspects, the present invention provides a laboratory fume hood which substantially removes contaminants from the work area as quickly as they are generated.

In an additional aspect, the present invention provides a laboratory fume hood which substantially contains contaminants in the area of the source so that the contaminants are not mixed throughout the total interior air volume.

In a further aspect, the present invention provides a laboratory fume hood which permits largely laminar air flow moving through the sash opening and directly into the exhaust system. This flow minimizes the "roll" or vortex typical in fume hoods of the prior art.

According to the present invention, the foregoing and other aspects are achieved, in one embodiment, by an exhaust hood which comprises a cabinet, an exhaust plenum and a vertically mounted sash. The exhaust plenum is located at a rear face of the cabinet and is defined by the rear face and a multi-structural baffle. Each structure of the baffle defines a plenum zone through which air entering an opening in a front face of the cabinet enters the plenum. In other words, air entering through a lower portion of the opening primarily enters the plenum through a first plenum zone and air entering through an upper portion of the opening primarily enters the plenum through a second plenum zone, the second zone being located above the first zone. Optionally, the baffle may contain a third structure defining a third plenum zone that is located between the first and second zones. In this embodiment, air entering an intermediate portion of the opening primarily enters the plenum through the third zone.

The vertically mounted sash may be adjusted to various heights thereby changing the size of the opening in the front face. When the sash is raised to a first height, air flows primarily across the work area and into the first structure. When the sash is raised to a second height, air entering the lower portion of the opening flows primarily across the work area and into the first structure and air entering the upper portion of the opening flows primarily across the work area and into the second structure. Optionally, the sash may be raised to a third height whereby air entering the intermediate portion of the opening flows primarily across the work area and into the third structure. The flow of air selectively entering vertically spaced plenum zones results in a substantially laminar flow of air through the work area.

Aspects of the present invention are further achieved by a sash handle for use with an exhaust hood sash which is spaced from the sash and thus permits the passage of air between the sash and the handle. The handle of the present invention comprises a slotted or perforated rear plate, an upper arm portion which extends outwardly and upwardly from an upper edge of the plate and a lower arm portion which extends outwardly and upwardly from a lower edge of the plate. The shape and positioning of the upper and lower arm portions forms a cavity between the arm portions and the rear plate which guides the passage of air at the same velocity as the inflow air to the primary hood opening thereby sweeping contaminated air away from the opening without creating turbulence.

Aspects of the present invention are further achieved by an air foil for use with an exhaust hood, the air foil being positioned in the area of the front edge of the bottom surface of the hood. The foil of the present invention includes a curved plate having a plurality of apertures therein, the plate extending from the front edge of the bottom surface toward the work area defined by the hood. The plate terminates at a position spaced from the bottom surface. As such, air is allowed to sweep the floor of the work area and across the surface of the airfoil at higher speed than would otherwise be possible by entering through the apertures in the plate and exiting into the work area through the space between the plate and the bottom surface. The air flow across the work surface is enhanced by a radiused front edge on the surface to optimize air speed.

Further aspects of the present invention are achieved by an air stabilizing device for use with an exhaust hood cabinet which includes first and second dividers which are spaced from one another and extend outwardly from a rear face of the hood and into the work area defined thereby. This placement of dividers permits air to be contained between the dividers and aids in preventing its permeation into other areas of the hood.

A feature of the invention is the incorporation of a deflector for controlling the direction of bypass air which passes across the inside of the sash when the latter is closed or partially closed and to direct air into the top of the work area to eliminate the build of contaminants.

Additional aspects of the present invention are achieved by an air flow regulating device for use with an exhaust hood which includes one or more side shields extending at an angle between the vertical side faces of the hood and the front face thereof. Each side shield has apertures therein permitting air to flow through the shields. However, positioned at an angle as taught by the present invention, a portion of the air that would otherwise enter the opening in the front face is prevented from entering the work area and thus less air fluctuation occurs in the work area.

Aspects of the present invention are further achieved by a floor for use with an exhaust hood which includes a plurality of elongated U-shaped channels which are aligned substantially parallel to the vertical side faces of the hood. Accordingly, air is allowed to flow beneath the work surface as it may flow through the channels toward the rear plenum. Optionally, the floor may be removable. Thus, if a user spills a liquid onto the floor of the hood, much of the liquid will accumulate in the channels and away from the working surface. The spill is then easier to clean as the floor may be removed and washed away from the hood itself.

Additional aspects of the invention, together with the advantages and novel features appurtenant thereto, will be set forth in part in the description which follows, and in part will become apparent to those skilled in the art upon examination of the following, or may be learned from the practice of the invention. The aspects and advantages of the invention may be realized and attained by means, instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are employed to indicate like parts in the various views.

DETAILED DESCRIPTION OF THE DRAWINGS

The present invention is directed to an improved laboratory fume hood. The particular embodiments described herein are intended in all respects to be illustrative rather than restrictive. Alternative embodiments will become apparent to those skilled in the art to which the present invention pertains without departing from its scope.

Figure 5:
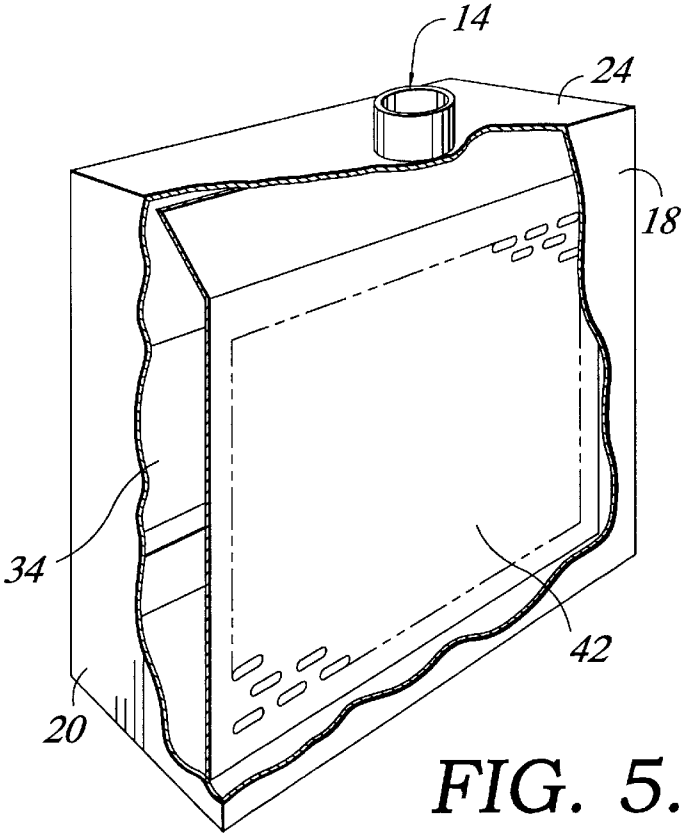
FIG. 5 is a perspective view of one embodiment of the present invention with a portion of the rear wall broken away to illustrate a single plenum chamber.
Figure 1:
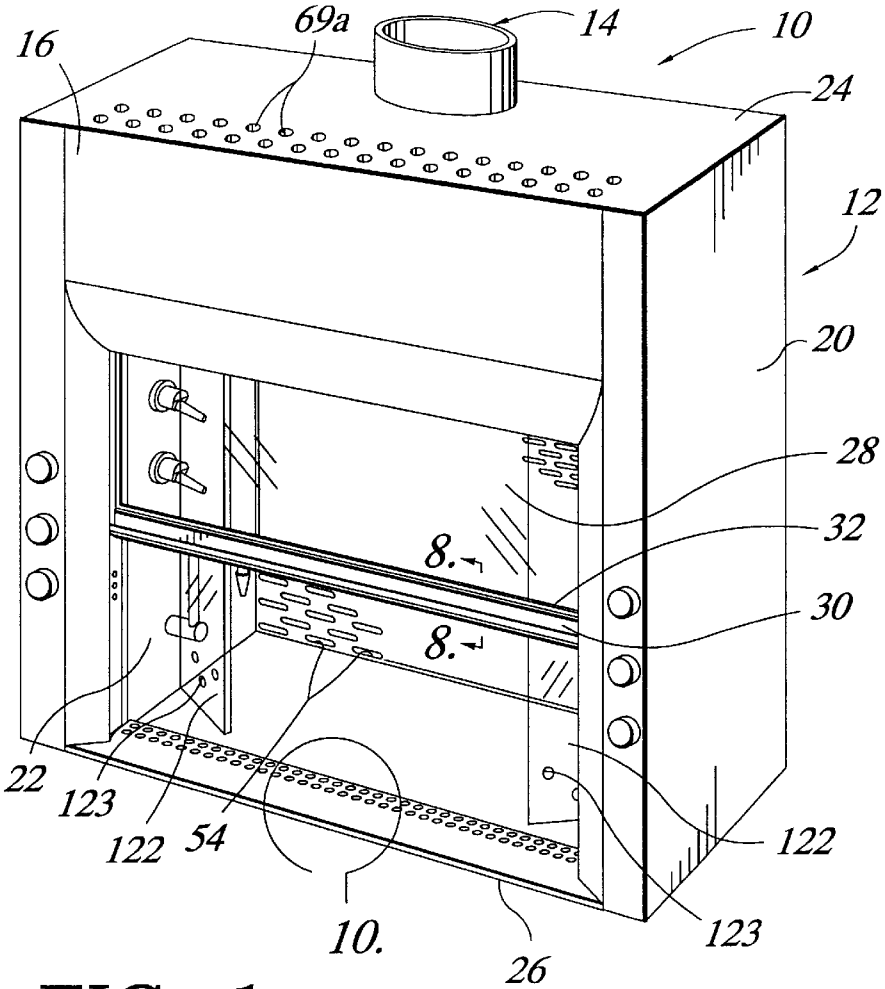
FIG. 1 is a front perspective view of a laboratory fume hood constructed in accordance with a preferred embodiment of the invention.
Figure 6:
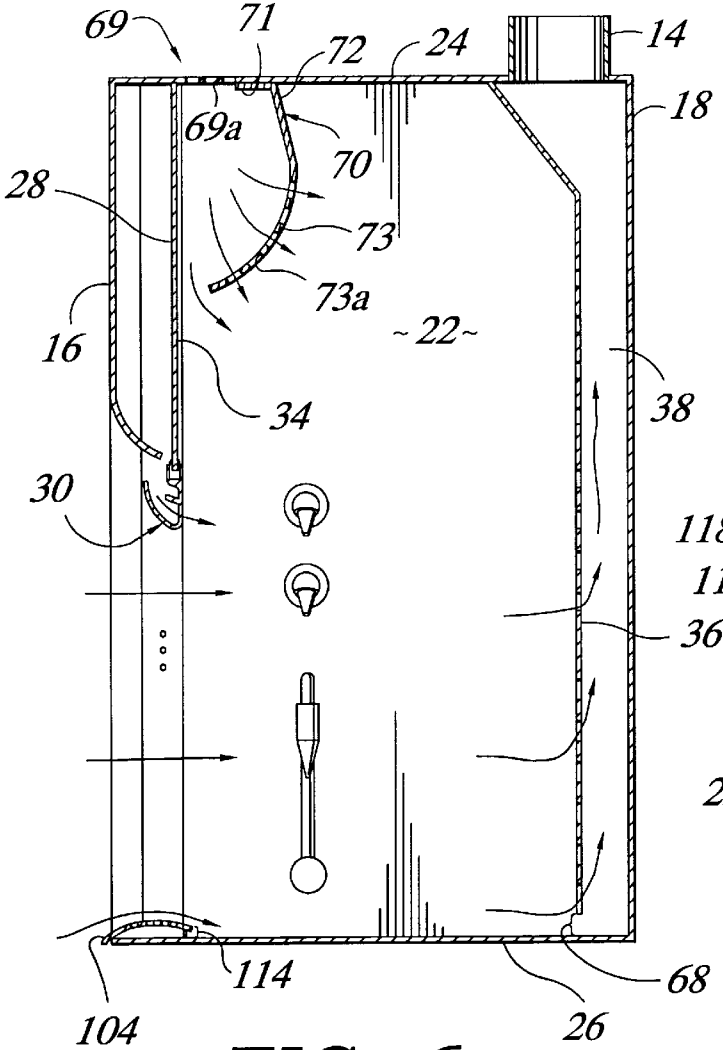
FIG. 6 is a vertical sectional view taken along line 6—6 of FIG. 2 in the direction of the arrows.

Referring to the drawings in general and initially to FIGS. 1 and 6 in particular, an exemplary laboratory exhaust hood manifesting aspects of the present invention is shown and is designated generally by the numeral 10. Exhaust hood 10 includes a cabinet structure 12 and an exhaust system 14. Cabinet 12 includes a front face 16, a rear face 18, opposing vertical side faces 20, 22, a top face 24 and a bottom face 26, all of which collectively form an enclosure defining a work area. Front face 16 includes an opening therein for providing access to the work area and a moveable sash 28 for selectively opening and closing the opening. Sash 28 is vertically mounted and is formed of a transparent material permitting a user to view the contents of the work area, even when the sash is in a closed position. Sash 28 includes a handle 30 mounted at a lower edge 32 thereof which increases the ease with which a user may raise or lower the sash and provides air flow to the interior surface 34 of the sash, i.e., the surface facing the work area. The details of handle 30 are more fully described below.

Exhaust system 14 (exhaust duct only shown) generally includes an exhaust fan (not shown). The exhaust fan draws fumes from the work area, thereby creating a face velocity across the opening in front face 16 to direct fumes away from the work area. The exhaust fan is connected to an opening in top face 24. The exhaust fan draws fumes accumulated in the work area to an outside area. Such venting systems for fume hoods are well known in the art and will not be described further herein.

Figure 12:
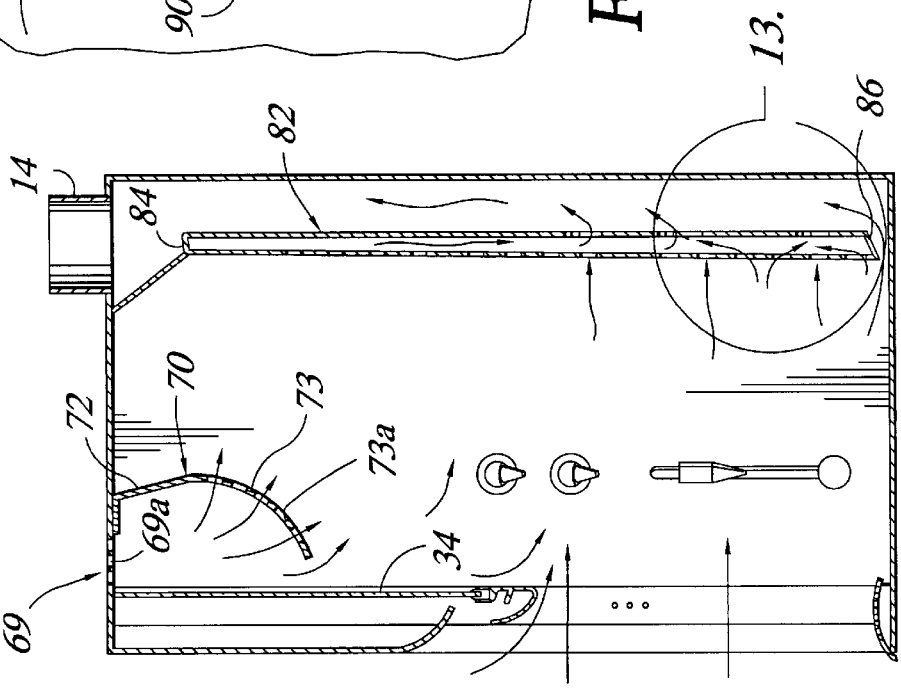
FIG. 12 is a vertical sectional view similar to that of FIG. 6, illustrating an alternate embodiment for the structure defining the rear plenum.
Figure 11:
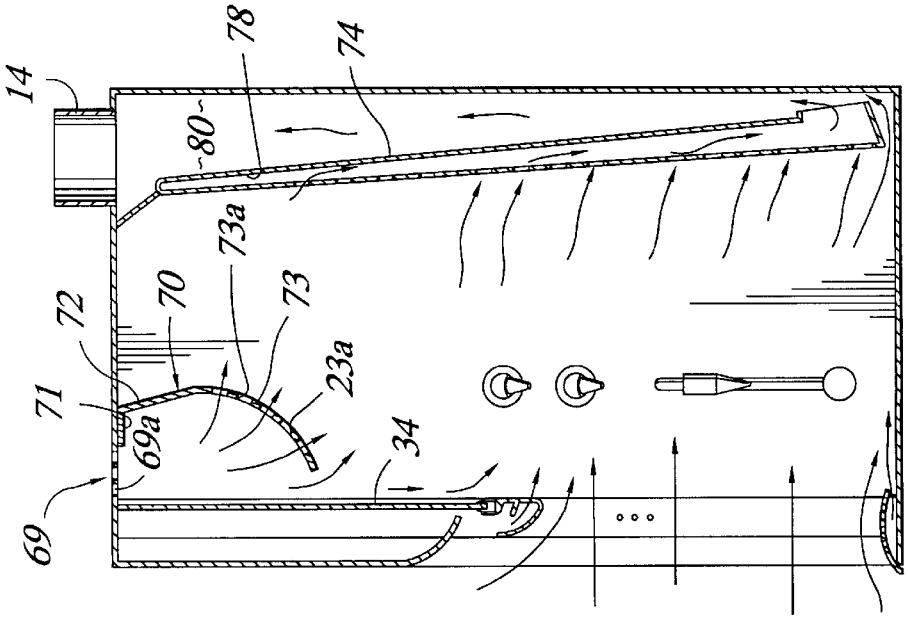
FIG. 11 is a vertical sectional view similar to that of FIG. 6, illustrating an alternative embodiment for the structure defining the rear plenum.

As best seen in FIG. 6, adjacent rear face 18, cabinet 12 further includes a baffle 36 which is spaced from the rear face defining a plenum chamber 38 therebetween. Optionally, plenum chamber 38 may be further defined by an intermediate wall, which is located between rear face 18 and baffle 36 (see FIGS. 11 and 12). The alternative embodiments shown in FIGS. 11 and 12 are discussed in detail below. Again referring to FIG. 6, in operation, air and contaminants from the work area enter plenum chamber 38 through baffle 36 and are exhausted through exhaust system 14, as more fully described below.

Figures 8, 9, 10, 14:
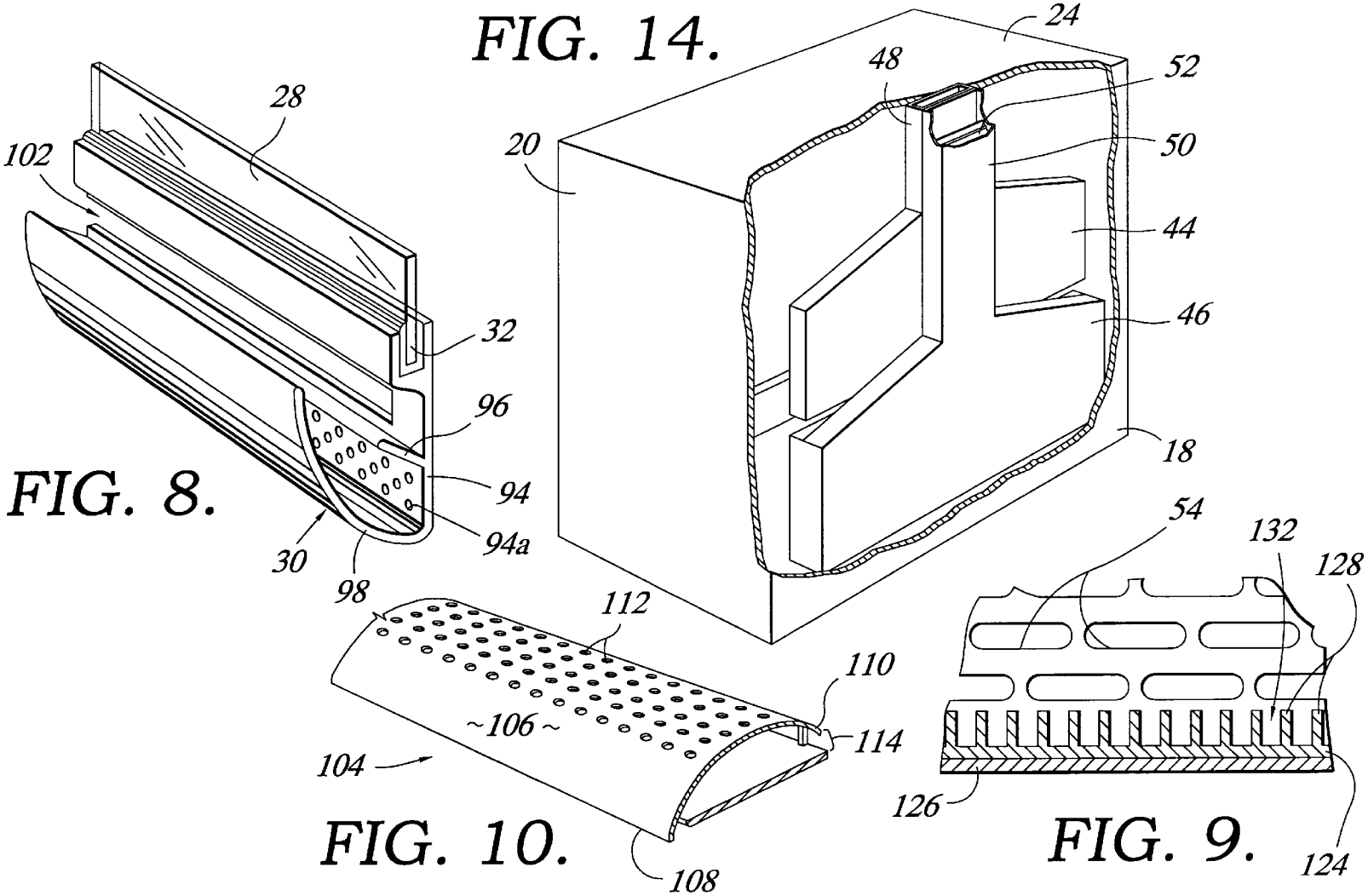
FIG. 8 is an enlarged, fragmentary perspective view of a sash handle constructed in accordance with a preferred embodiment of the present invention partially shown in cross-section, the section taken along line 8—8 of FIG. 1 in the direction of the arrows.
FIG. 9 is a horizontal sectional view taken along line 9—9 of FIG. 4 in the direction of the arrows.
FIG. 10 is an enlarged, fragmentary perspective view, partially in cross-section, of the area encircled and identified by the numeral 10 in FIG. 1.
FIG. 14 is a perspective view of an alternate embodiment of the present invention with a portion of the rear wall broken away to illustrate a dual plenum chamber.

Plenum chamber 38 may be either a single plenum section 42, as best shown in FIG. 6, or may comprise dual plenum sections, as best shown in FIG. 14. In the embodiment comprising dual plenum sections, plenum chamber 38 preferably includes an upper plenum section 44 and a lower plenum section 46. Upper section 44 is located vertically above lower section 46. The exhaust ducts 48, 50, respectively, for upper section 44 and lower section 46 are located parallel to one another, upper duct 48 being located in front of lower duct 50 toward the work surface. As seen in FIG. 14, lower duct 50 includes a damper 52 therein for controlling air flow out of lower plenum section 46. Though not shown in FIG. 14, it will be understood and appreciated that upper section 44 similarly includes an independently actuated damper 52 (see FIG. 18) for controlling air flow our of upper plenum section 44. In the preferred embodiment, upper and lower plenum sections 44, 46 correspond to the positioning of sash 28 as more fully described below.

Figure 2:
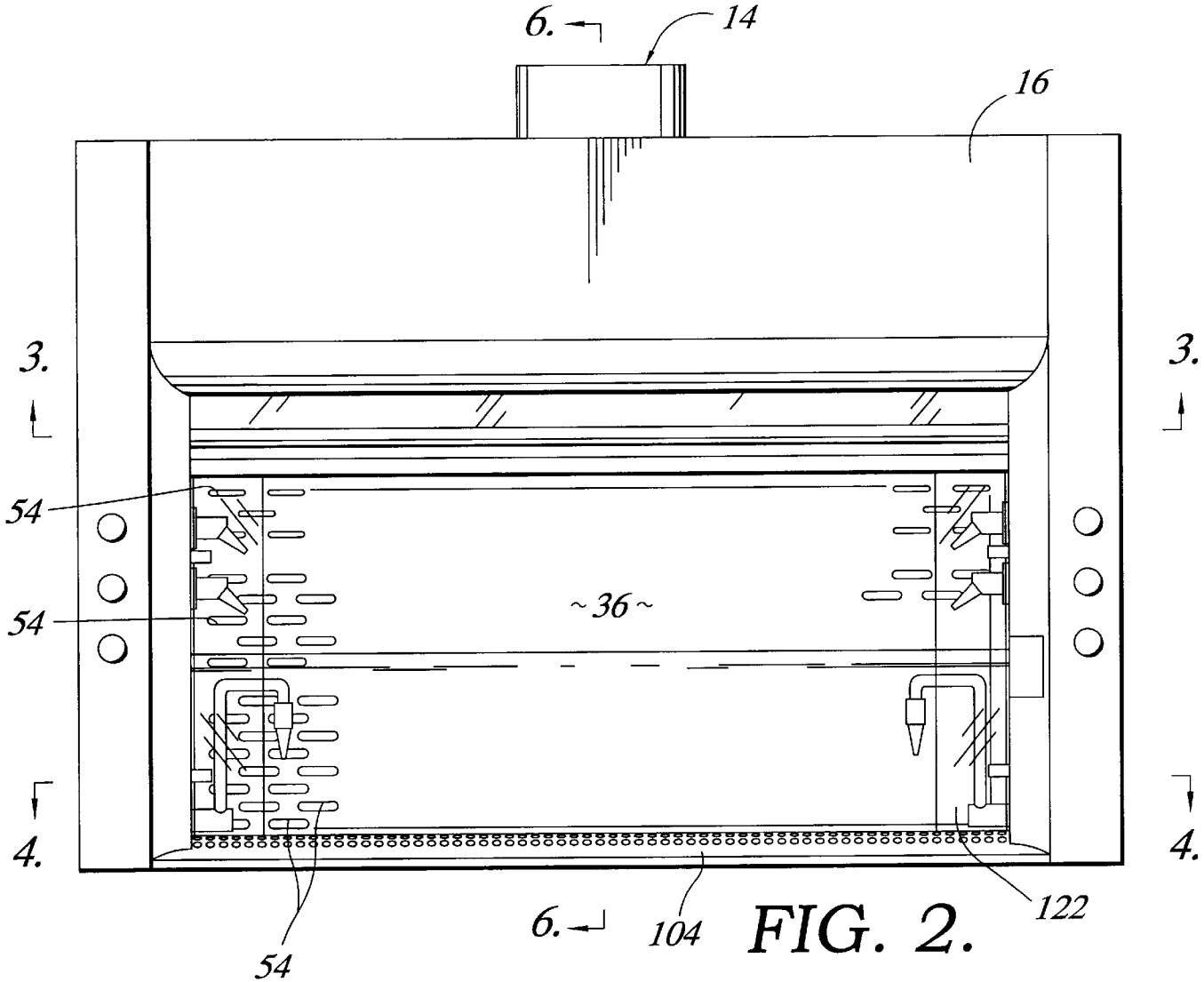
FIG. 2 is a front elevational view of a laboratory fume hood constructed in accordance with the present invention.
Figure 3:
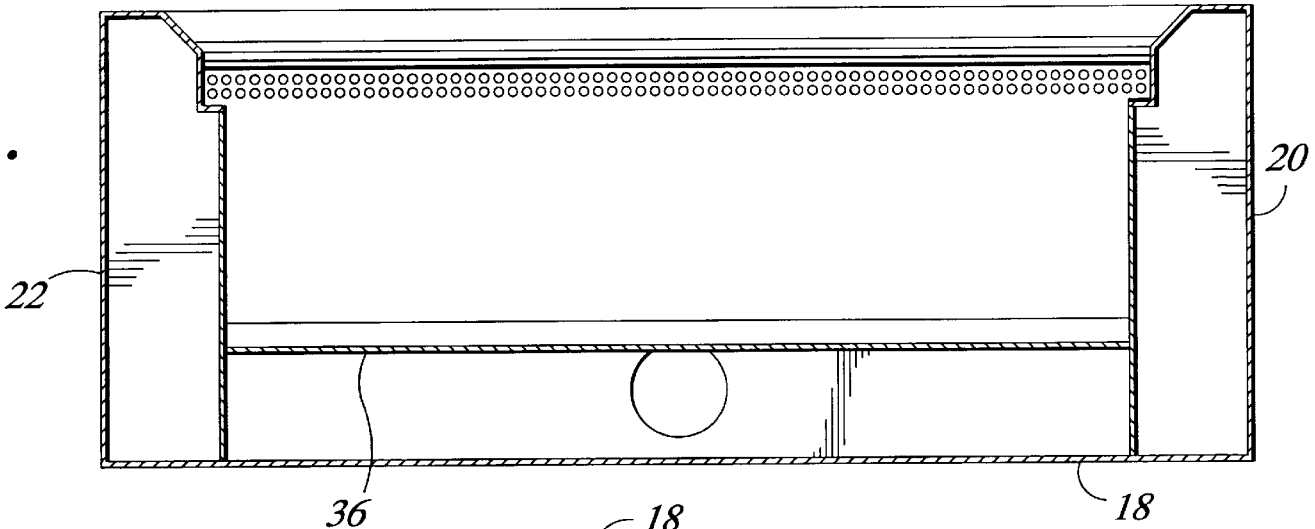
FIG. 3 is a horizontal sectional view taken along line 3—3 of FIG. 2 in the direction of the arrows.
Figure 4:
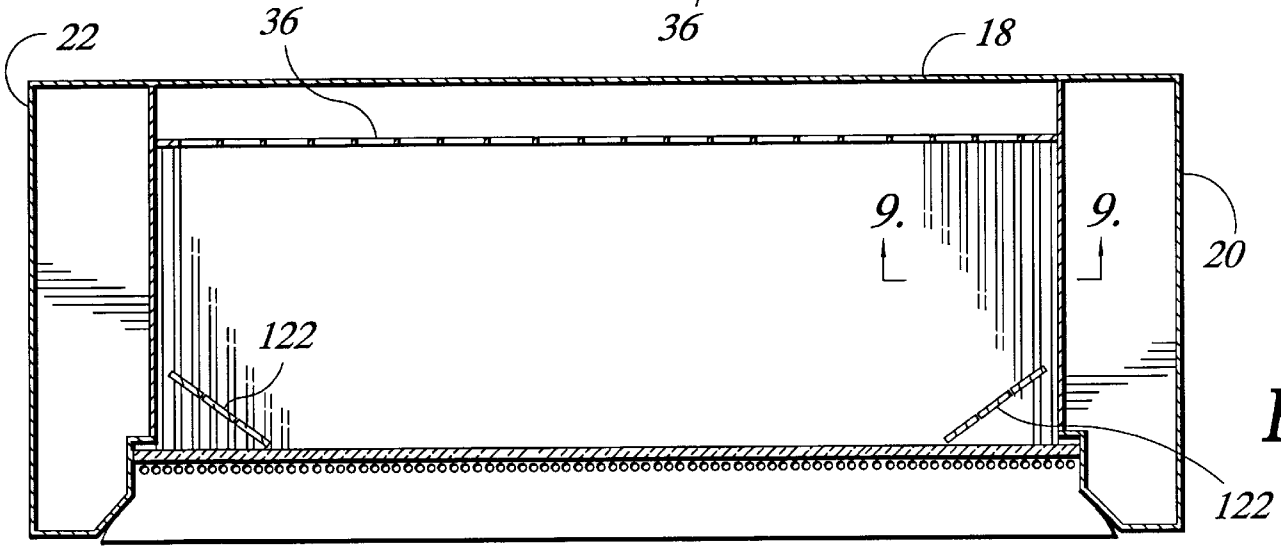
FIG. 4 is a horizontal sectional view taken along line 4—4 of FIG. 2 in the direction of the arrows.
Figure 15:
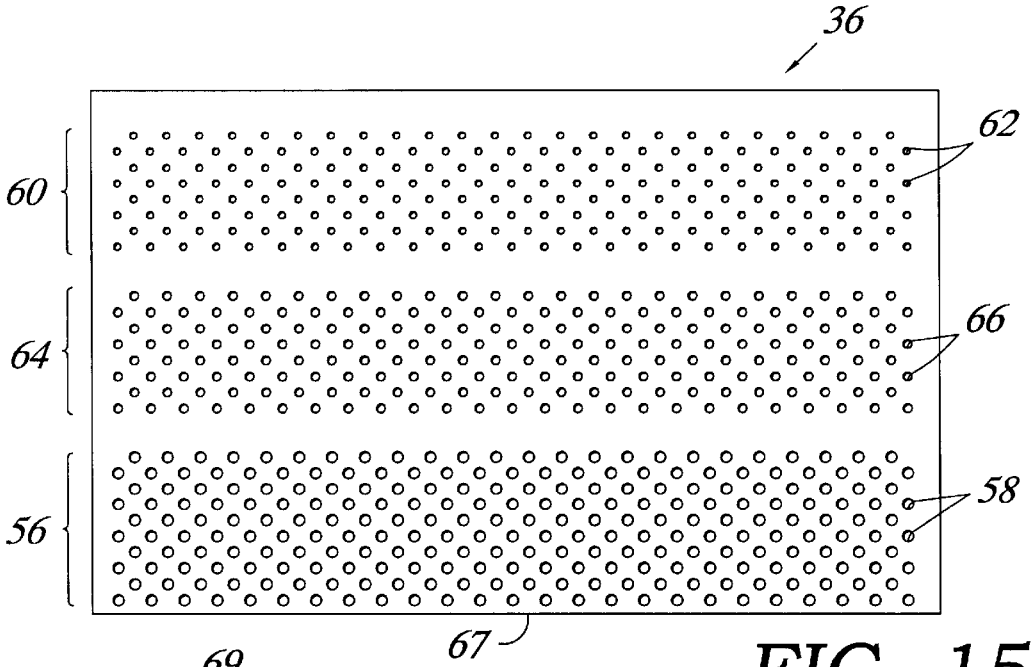
FIG. 15 is a front elevational view of the rear face of a laboratory fume hood constructed in accordance with a preferred embodiment of the present invention.

Returning to the preferred embodiment of FIGS. 1–6 and particularly to FIG. 2, Baffle 36 is of generally planar construction and includes a plurality of apertures 54 therein. The apertures within each structure may be of any desired shape. For ease of description, the relative sizes of the apertures will be discussed herein as though each aperture has a circular configuration. However, it will be understood and appreciated that the apertures may be of any desired shape and such shape variations are contemplated to be within the scope of the invention. Preferably, the apertures are either circular or of a horizontally elongated oval configuration. More preferably, the apertures have a horizontally elongated oval configuration, as illustrated in FIGS. 1 and 2, as this orientation is less distracting and straining on the eyes of the user. Apertures 54 are arranged in plenum zones, each zone including apertures which are of a substantially consistent size within the zone. As best seen in FIG. 15, the size of the apertures among different zones, however, varies. In a preferred embodiment, baffle 36 includes three plenum zones which respectively are defined by three plenum structures. Lower plenum zone one is defined by first structure 56 having apertures of a first size 58, upper plenum zone two is defined by second structure 60 having apertures of a second size 62, and intermediate plenum zone three is defined by third structure 64 having apertures of a third size 66. The designations "upper", "lower" and "intermediate" refer to the relative positions of the plenum zones along the vertical plane of baffle 36. In other words, the upper plenum zone is located vertically above the intermediate plenum zone which is, in turn, located vertically above the lower plenum zone.

The area of open space in each plenum structure is defined by the sum of the surface areas of all apertures with that structure. The area of open space in first plenum structure 56 is greater than the area of open space in third plenum structure 64 which is, in turn, greater than the area of open space in second plenum structure 60. By way of example, in a baffle having a horizontal dimension of 62.12 inches and a vertical dimension of 38.12 inches, it is preferred that the area of open space in first plenum structure 56 is between 0.70 and 0.80 square feet, the area of open space in third plenum structure 64 is between 0.37 and 0.47 square feet, and the area of open space in second plenum structure 60 is between 0.18 and 0.28 square feet. More preferably, the area of open space in first plenum structure 56 is between 0.725 and 0.775 square feet, the area of open space in third plenum structure 64 is between 0.39 and 0.45 square feet, and the area of open space in second plenum structure 60 is between 0.20 and 0.25 square feet. Most preferably, the area of open space in first plenum structure 56 is 0.752 square feet, the area of open space in third plenum structure 64 is 0.417 square feet and the area of open space in second plenum structure 60 is 0.234 square feet. The foregoing dimensions are for a standard fume hood size of approximately 46–48 cubic feet (internal volume). The same relative ratio of open areas should be maintained for smaller or larger hoods.

In its preferred embodiment of FIGS. 1–6, baffle 36 is constructed with the dimensions indicated above wherein first structure 56 includes ten horizontal rows of apertures, each having a diameter of 0.75 inches, third structure 64 includes eight horizontal rows of apertures, each having a diameter of 0.62 inches, and second structure 60 includes eight horizontal rows of apertures, each having a diameter of 0.50 inches. In each of first structure 56, second structure 60 and third structure 64, the rows of apertures are offset as shown in FIG. 15 such that the apertures in a given row are horizontally centered between the apertures in the rows immediately above and below. As such, the apertures in every other row are vertically aligned. The centers of the apertures in each row are horizontally spaced 2.5 inches apart. The centers of the apertures are vertically spaced 2.25 inches apart from the vertically aligned aperture which is two rows above or below. Further, the centers of the apertures in the top row of each of first and third structures 56, 64 are spaced 2.75 inches from the centers of the apertures in the structure located directly above that structure. In the preferred embodiment, then, there is a visually apparent distinction between each of first structure 56, third structure 64 and second structure 60. Additionally, there is an area above second structure 60 which is void of apertures altogether. It is to be understood and appreciated that the pattern of apertures may be varied. However, the relative open areas in zones one, two and three will remain substantially the same.

In the preferred embodiment, the lower edge 67 (FIG. 11) of baffle 36 is spaced from bottom face 26 by approximately one inch creating an elongated opening 68 (FIG. 13) just beneath the baffle. Opening 68 permits additional inflow of air into plenum chamber 38 as more fully described below. Opening 68, in conjunction with the apertures in each of the plenum structures, creates a total open space of approximately 1.83 square feet.

Figure 16:
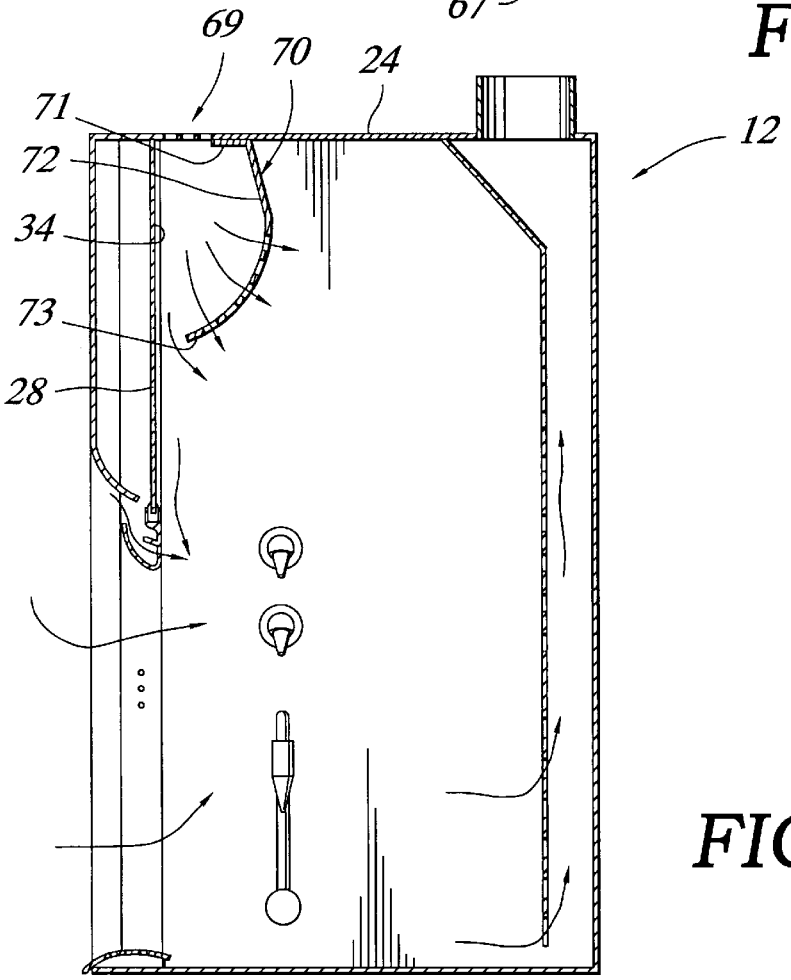
FIG. 16 is a vertical sectional view similar to that of FIG. 6, illustrating a structure for guiding bypass air into the work area.

As best seen in FIG. 16, cabinet 12 further includes an intake 69 in top face 24 for supplying dilution air across the interior surface 34 of sash 28. Intake 69 comprises a plurality of openings 69*a*. In a fume hood having the dimensions previously described, intake 69 preferably is approximately 2.0 inches measured from interior surface 34 rearwardly toward the rear of cabinet 12. Intake 69 extends across substantially the entire horizontal width of sash 28.

Located proximate intake 69 in the upper portion of the work area, is a perforated air guide 70 (FIGS. 6, 11 and 12) for directing the air entering the work area through the intake. Air guide 70 includes a top arm portion 71 extending substantially parallel to the top face 24 and coupled therewith, an angled downward arm portion 72 extending rearwardly from the top arm portion, and a curved guide portion 73 which arcs from the downward arm portion toward interior sash surface 34. Guide portion 73 terminates at a location spaced from interior sash surface 34 such that air may flow therebetween. Further, guide portion 73 contains a plurality of apertures 73*a* through which air may flow. Air guide 70 extends substantially the horizontal length of intake 69.

In operation of the embodiment of FIGS. 1–6, as dilution air enters intake 69, a portion of the air is directed along the interior surface 34 of sash 28 prior to entering the more central portions of the work area. This aids in preventing the accumulation of contaminants behind sash 28 thus substantially eliminating contaminants in the actual breathing zone of the user. A portion of the air entering intake 69 is also directed through the apertures 73*a* in guide portion 73. Guide portion 73 is angled such that air flowing through the apertures therein is directed into the upper portion of the work area. As such, gas and other contaminant concentrations are reduced in this upper portion and stagnant air pockets are substantially eliminated. Any contaminates in this area are continually swept down and toward the back of the hood where they are evacuated. The configuration of guide 73 promotes laminar flow across the top area of the hood and reduces rolling turbulence which is more likely to occur if all of the bypass air is directed along the back surface 34 of sash 28.

As previously stated, sash 28 is movable for selectively opening and closing the opening in front face 16. In the preferred embodiment, the sash is movable between a fixed number of preset positions, each position corresponding with one of plenum structures 56, 60 and 64. For instance, when the sash is in its first and lowermost position, the opening is substantially closed to air flow. When sash 28 is open to a second position, which is indicated to the user by a resistance which is encountered as the sash is moved to the present position, the lower edge of handle 30 is in substantially the same horizontal plane as the top edge of first plenum structure 56. Because air entering the opening in front face 16 will follow the path of least resistance, most of the air passing through the interior of the hood will enter plenum chamber 38 through apertures 58 in first plenum structure 56. As both the entry and exhaust areas are of approximately equal dimension, a substantially laminar air flow through the sash opening and into the exhaust system results. As such, a lower inflow air velocity is needed to exhaust the incoming air and the contaminants present in the work area. Thus, the energy required to condition the exhausted air, i.e., to reduce the contaminant concentration to an acceptably low level for exhausting, is reduced and less conditioned air is removed from the building housing hood 10.

Likewise, when sash 28 is open to a third position, the lower edge of handle 30 is in substantially the same horizontal plane as the top edge of third plenum structure 64. Again, because air entering the opening in front face 16 will follow the path of least resistance, the air entering the lower portion of the face opening will enter plenum chamber 38 through apertures 58 in first plenum structure 56 and the air entering the upper portion of the face opening will enter the plenum chamber through apertures 66 in third plenum structure 64. The result, again, is that the entry and exhaust areas are of approximately equal dimension and a substantially laminar air flow through the sash opening and into the exhaust system is achieved. A lower inflow air velocity is thus needed to exhaust the incoming air and the contaminants present in the work area.

When sash 28 is open to a fourth (fully open) position, lower edge 32 of handle 30 is in substantially the same horizontal plane as the top edge of uppermost plenum structure 60. Again, because air entering the opening in front face 16 will follow the path of least resistance, the air entering the lower portion of the face opening will enter plenum chamber 38 through apertures 58 in first plenum structure 56, the air entering the intermediate portion of the face opening will enter the plenum chamber through apertures 66 in third plenum structure 64, and the air entering the upper portion of the face opening will enter the plenum chamber through apertures 62 in the second (uppermost) plenum structure 60. The result, again, is that the entry and exhaust areas are of approximately equal dimension and a substantially laminar air flow through the face opening and into the exhaust system is achieved. A lower inflow air velocity is thus needed to exhaust the incoming air and the contaminants present in the work area.

Figure 17:
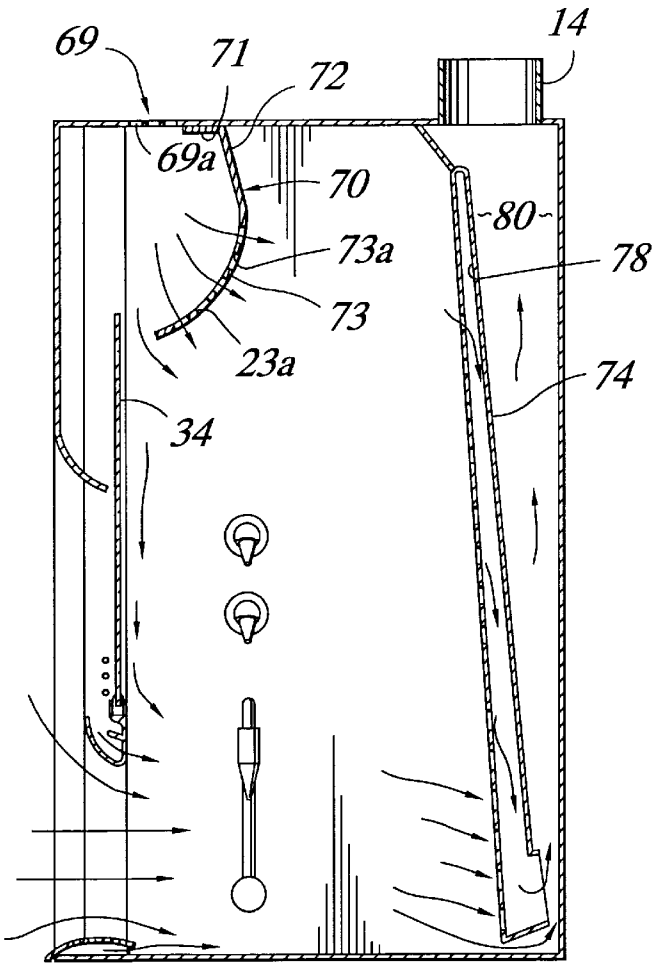
FIG. 17 is a vertical sectional view similar to FIG. 16 with the sash illustrated in the half closed position.

The air flow pattern for the hood 10 having a single plenum chamber 38 is illustrated by the arrows in FIG. 16. In this figure, sash 28 is shown in its fully open position and the arrows indicate the flow of air across the face opening to baffle 36 where the air enters each of the plenum zones 56, 64 and 60 before being exhausted through the plenum chamber 38. FIG. 17 illustrates the air flow pattern with the sash 28 in a partially closed position, approximately half open. In this sash position the majority of air flow passing through the interior of the hood is directed to lower plenum structure 56 defined by openings 58 (see FIG. 15). Again, however, the air flow is substantially laminar as a result of the sizing of openings 58 so as to accommodate substantially all of the air flow passing through the face opening.

While the invention has been described with reference to a plurality of distinct plenum zones it is to be understood that the number of zones may vary and that the transition between the zones may be gradual with the size of the openings gradually varying rather than having distinct groups of sizes.

Accordingly, in operation, baffle 36 creates a largely horizontal, laminar air flow moving through the face opening and exhausting through the exhaust system wherein both entry and exhaust areas are of approximately equal dimension. This smooth horizontal flow of lower velocity air at all times minimizes the potential for the air to roll and for contamination to move down the interior of the sash. As such, the hood may be operated at lower inflow air velocities and the energy required to exhaust the air is reduced. Further, the laminar flow of air permits contaminants to be exhausted on the "first pass" nearly as quickly as they are generated without creating air turbulence which could compromise the procedures being performed and increase the threat of injury to the operator. The result is a hood which better contains contaminants generated therein, which is less susceptible to external conditions, traffic patters near the face opening and work procedures, and which has enhanced safety during operation.

It will be understood and appreciated that while the above discussion focuses on a sash having four distinct preset positions, ranging from substantially closed to fully open, the important feature is that the sash position correspond to the various plenum structures in the baffle. Thus, in a baffle having two plenum structures rather than three, the sash would have three preset positions rather than four. Additionally, it will be understood that the same result may be achieved in a sash wherein the positions are not preset but the operator simply substantially aligns the bottom edge of the handle with the appropriate plenum structure manually. Such variations are contemplated to be within the scope of the invention.

In an exhaust hood having distinct and independent plenum sections as shown in FIG. 14, it is preferred that baffle 36 contain the same number of plenum structures as there are plenum sections. In the embodiment shown in FIG. 14, there are two plenum sections 44, 46 and two corresponding plenum structures. In this embodiment, the first plenum structure is aligned with the lower plenum section 46 and the second plenum structure is aligned with the upper plenum section 44. In the operation of a hood constructed according to the alternative embodiment of FIG. 14, when sash 28 is raised to a first height wherein the lower edge of handle 30 is in substantially the same horizontal plane as the top edge of lower plenum section 46, air entering the opening in front face 16 enters the lower plenum section through apertures 58 in the first plenum structure and is exhausted through exhaust duct 50. The damper in upper plenum section 44 is substantially closed thus precluding substantial air from being exhausted through exhaust duct 48. When sash 28 is raised to a second height wherein lower edge 32 of handle 30 is in substantially the same horizontal plane as the top edge of upper plenum section 44, dampers in both plenum sections 44 and 46 are open. Thus, air entering a lower portion of the opening enters lower plenum 46 through apertures in the first plenum section and is exhausted through exhaust duct 50. Air entering an upper portion of the opening enters upper plenum structure 44 through the apertures in the second plenum structure and is exhausted through exhaust duct 48. It is preferred that in the dual plenum section embodiment, the air flow from both plenum sections 44 and 46 culminate in a single exhaust outlet, each duct independently coupled therewith.

Figure 18:
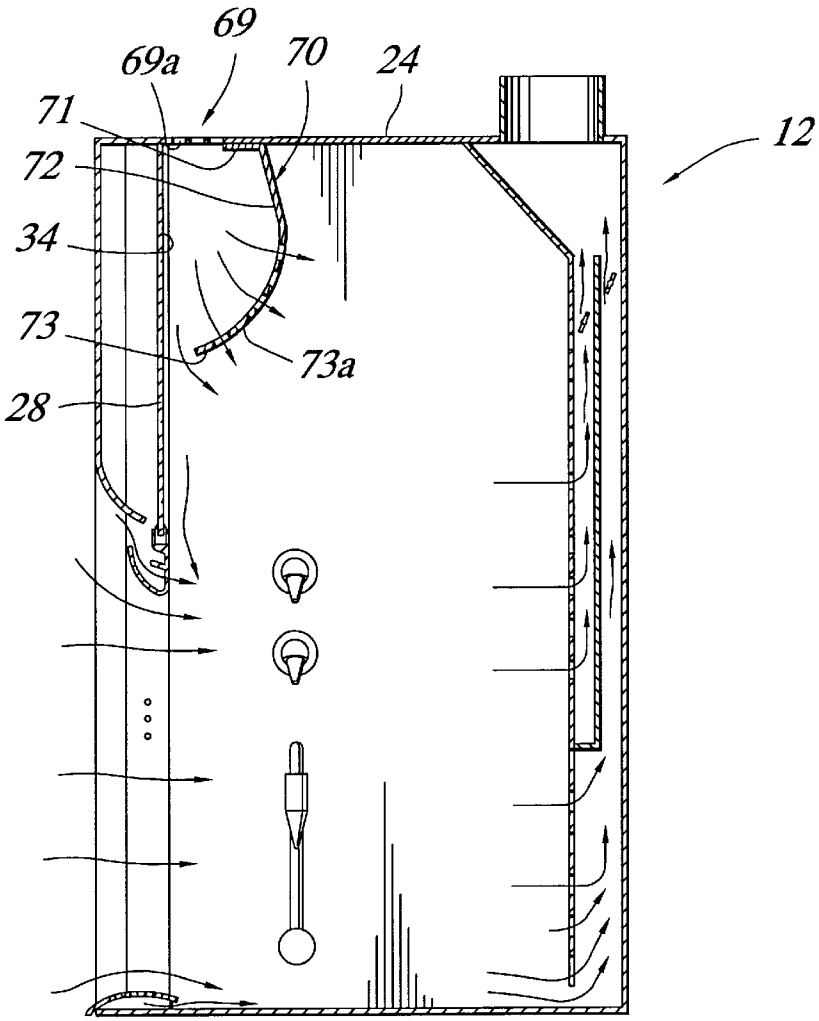
FIG. 18 is a vertical sectional view of the alternative embodiment of FIG. 14 with the sash in its fully open position.
Figure 19:
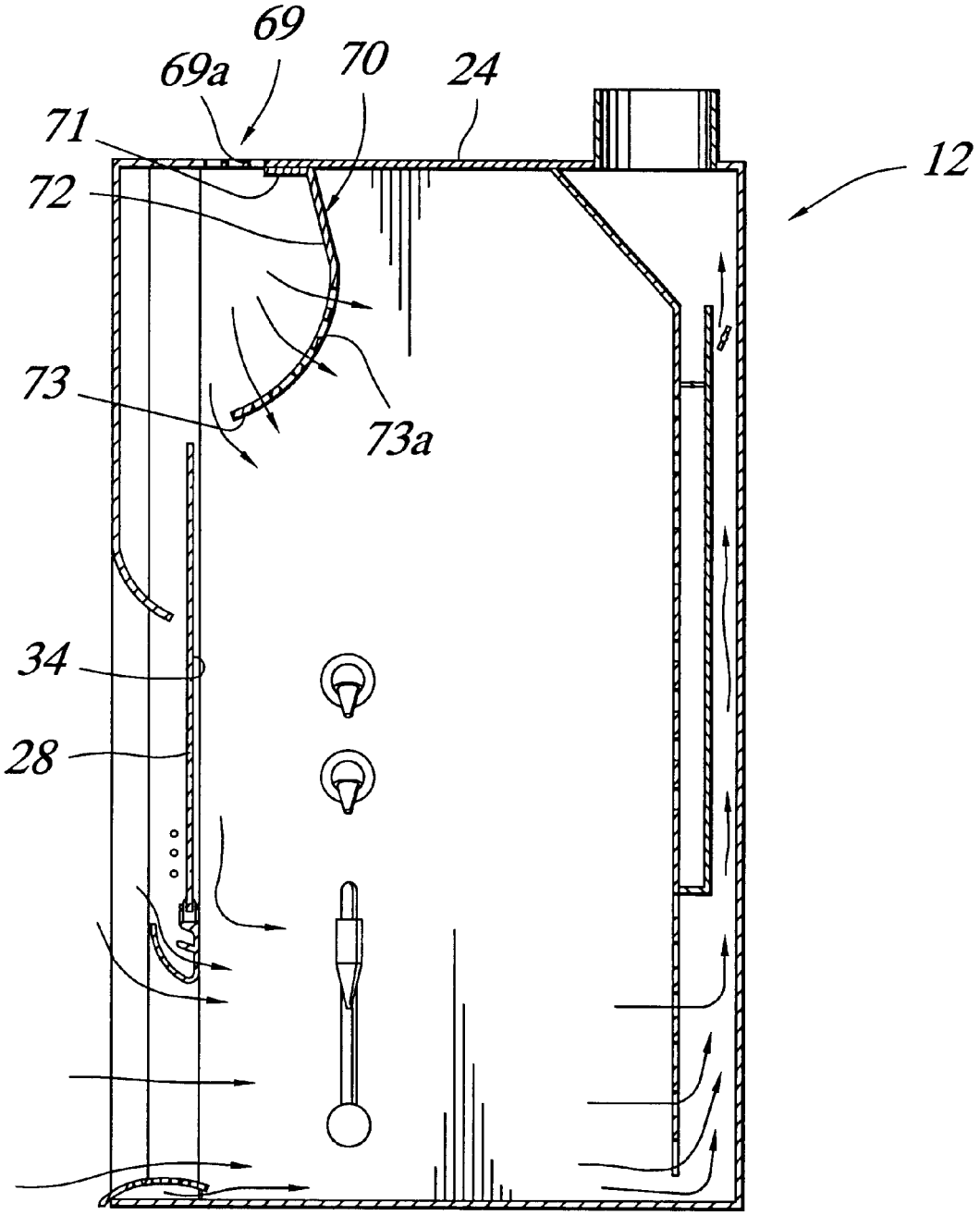
FIG. 19 is a vertical sectional view similar to FIG. 18 with the sash in its partially closed position.

The air flow pattern for the embodiment of FIG. 14 utilizing dual plenum chambers 44 and 46 is illustrated in FIGS. 18 and 19. In FIG. 18, sash 28 is shown in its fully raised position which results in air flow through both the upper and lower plenum chambers. Thus, dampers 52 are open so as to accommodate air flow through the independent plenum sections. As shown by the arrows, the air flowing through the face opening travels in a substantially laminar pattern to baffle 36 and then into the two independent plenum sections. FIG. 19 illustrates the hood of FIG. 18 with sash 28 in a partially closed, partially open position wherein the lower edge of the sash is at approximately the same height as the lower edge of the upper plenum section 44. In this position damper 52 is closed so that all of the air passing through the face opening enters the lower plenum section 46 where it is evacuated. It is to be understood that movement of dampers 52 can be automatically controlled by a controller which is activated by movement of sash 28. Thus the dampers do not have to be fully closed or fully open but may be partially closed as the sash moves from a fully closed to a fully open position. As illustrated, however, the flow of air through the face opening follows a substantially laminar pattern regardless of the position of the sash as a result of the selection of the appropriate plenum section and damper setting to accommodate this air flow based upon the position of the sash.

With both the preferred embodiment of FIGS. 1–6 and the alternative embodiment of FIG. 14, it is to be understood that there is air flow across the entire cabinet interior at all times and accordingly there will be some air flow through all plenum zones at all times even though the predominant flow will be through the zone that corresponds to the height to which the sash is raised as explained herein. This assures a uniform air flow that is substantially laminar from the front to the back of the hood and precludes air from "rolling up" the back wall.

As stated above, plenum chamber 38 may be defined by an intermediate wall, in addition to baffle 36 and rear face 18. As illustrated in FIGS. 11 and 12, the intermediate wall may have varying characteristics. In one embodiment, the intermediate wall is designated 74 and is of solid construction, i.e., void of apertures. In this embodiment, baffle 36 includes an arm 75 protruding at an angle from lower edge 67 toward rear face 18. Intermediate wall 74 is of a shorter vertical length than baffle 36 such that an opening 76 is formed between the lower edge of the intermediate wall and the rearward edge of arm 75.

As is apparent from FIG. 11, in this embodiment, plenum chamber 38 comprises both the area between baffle 36 and intermediate wall 74, designated as front plenum section 78, and the area between the intermediate wall and rear face 18, designated as rear plenum section 80. In operation, air flows from the work area, through the apertures in baffle 36 into front plenum section 78, through opening 76 into rear plenum section 80 and is exhausted therefrom.

It is preferred that in this embodiment, baffle 36 is angled toward front face 16 approximately 3–5° off vertical. Further, it is preferred that arm 75 is angled from lower edge 67 of baffle 36 upwardly and toward rear face 18 at an angle of approximately 62°. Baffle 36 and intermediate wall 74 are approximately 1.49 inches from one another at the upper edge of opening 76 and the opening is approximately 2.35 inches from the rearward facing edge of arm 75 to the bottom edge of the intermediate wall. Intermediate wall 74 is slightly angled toward baffle 36 such that the distance between the baffle and the wall is less than 1.49 inches at the tops thereof where the two preferably are coupled with one another by means well known in the art. Additionally, it is preferred in this embodiment that elongated opening 68 is approximately 1.5 inches rather than 1.0 inch.

Figure 13:
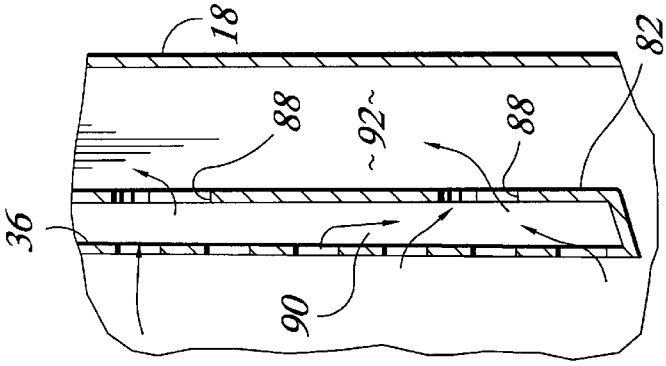
FIG. 13 is an enlarged view of the area encircled and identified by the numeral 13 in FIG. 12.

In a second alternative embodiment as shown in FIG. 12, the intermediate wall has a perforated construction. This embodiment is illustrated in FIGS. 12 and 13. The perforated intermediate wall of this embodiment is designated generally by the numeral 82. In this embodiment, a top arm 84 and a bottom arm 86 connect baffle 36 and intermediate wall 82 at the top and bottom ends thereof, respectively. In addition, intermediate wall 82 and baffle 36 are not parallel to one another. Rather, the distance of separation between the intermediate wall and the baffle is approximately 0.57 inches at the top ends thereof and approximately 2.00 inches near the bottom ends thereof. As such, top arm 84 is angled from baffle 36 by approximately 97° and bottom arm 86 is angled from intermediate wall 82 by approximately 79°.

It is preferred that intermediate wall 82 include two rows of apertures 88, (FIG. 13) those of the top row being fewer in number and of larger size than those of the bottom row. Preferably the apertures 88 of each of the top and bottom rows in intermediate wall 82 are rectangular in shape with rounded corners. However, it will be understood and appreciated that apertures 88 may be of any desired shape and such variations are contemplated to be within the scope of the present invention.

As with the embodiment illustrated in FIG. 11, in the alternative embodiment as shown in FIG. 13, plenum chamber 38 comprises both the area between the baffle 36 and intermediate wall 82, designated as front plenum section 90, and the area between the intermediate wall and rear face 18, designated as rear plenum section 92. In operation, air flows from the work area, through the apertures in baffle 36 into front plenum section 90, through apertures 88 into rear plenum section 92 and is exhausted therefrom.

As previously stated, exhaust hood 10 includes a sash 28 for opening and closing the opening in front face 16 into the work area. Sash 28 includes a handle 30 at the lower edge thereof, the preferred construction of which is best seen in FIG. 8. Handle 30 includes a rear plate 94, a top arm portion 96 and a bottom arm portion 98. Rear plate 94 is substantially planar and is disposed substantially vertical and includes a plurality of apertures 94*a* therein which are substantially evenly distributed across the plate. The size and shape of the apertures may vary dependent upon the particular applications to be performed. Top arm portion 96 extends outwardly toward the external laboratory environment and is angled upwardly from the top edge of plate 94. Top arm portion 96 is spaced from lower edge 32 of sash 28 across a substantial portion of the width of the sash forming an elongated opening 102 therebetween. Air flows from the external environment and into the work area through opening 102, providing air to the work area at the interior surface of sash 28.

Bottom arm portion 98 curves outwardly toward the external laboratory environment and upwardly from the bottom edge of rear plate 94. Bottom arm portion 98 is longer than top arm portion 96 and extends further into the external laboratory environment than the top arm portion. Additionally the curvature of bottom arm portion 98 increases as it extends outwardly beyond top arm portion 96 and terminates at approximately the level of lower sash edge 32. The combination of the substantially planar rear plate 94, upper arm portion 96 and curved lower arm portion 98, creates a channel through which air flows. In operation, air enters the channel from the external environment and flows through the perforations in rear plate 94 thus providing air to the work area at or near the interior surface of sash 28.

In operation, air flows from the external environment and into the work area through both elongated opening 102 and through the perforations in rear plate 94. The velocity of the air flowing through the handle equals the velocity of the air entering through the opening in front face 16 thus preventing turbulence from two adjacent air flows. Contaminants generated within the work area are forced further back into the work space decreasing the contaminant concentration behind the plane of sash 28. Since the bottom edge of the sash is most vulnerable to leakage, the concentration of contaminants escaping into the breathing zone of the operator is reduced.

Returning to FIG. 6, at or near the front edge of bottom face 26 is an air foil 104, the preferred construction of which is best seen in FIG. 10. Air foil 104 is comprised of a plate 106 having an arched surface from a front edge 108 thereof to a rear edge 110 thereof. Plate 106 includes a plurality of apertures 112 across its central portion. Preferably, the surface area of plate 106 nearest front edge 108 and extending approximately 15–25° through the arc is void of apertures, the central 35–75° of the surface contains apertures, and area of the plate nearest rear edge 110 and extending over approximately 15–25° of the surface contains no apertures. The apertures may be of any desired shape or size, dependent upon the applications to be performed in the hood, and are preferably evenly spaced throughout the aperture-containing area of plate 106.

In the preferred embodiment of air foil 104, the front edge 108 extends beyond the plane of the front face 16 and beyond the plane of bottom face 26. Further, rear edge 110 is spaced from bottom face 26 forming an elongated space 114 therebetween, as best seen in FIGS. 6 and 11. In operation, air passes through apertures 112 and exits through elongated space 114 "sweeping" the floor of the work area as illustrated by the arrow in FIG. 11. The shape of the foil aids in increasing the velocity of the air moving across the foil and the apertures therein help to counter partial blockage of air flow by a user positioned in front of fume hood 10.

Figure 7:
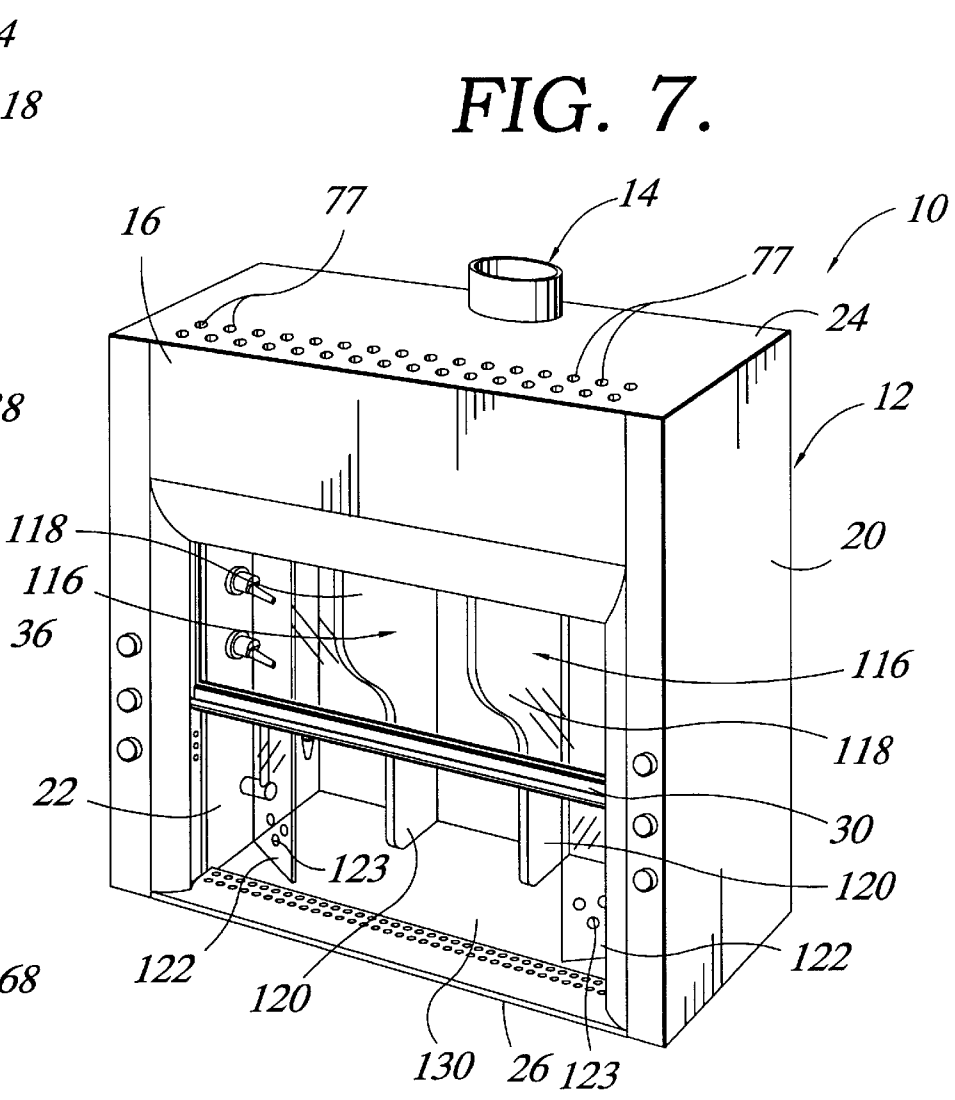
FIG. 7 is a perspective view of a laboratory fume hood constructed in accordance with an alternate embodiment of the present invention.

To more efficiently contain fumes generated within the work surface, cabinet 12 optionally may contain dividers 116 as best illustrated in FIG. 7. Dividers 116 extend outwardly from rear face 18 and are substantially perpendicular thereto. The dividers are spaced from one another and are centrally located along the horizontal plane of the rear wall. In the preferred embodiment, each divider 116 includes a top portion 118 and a bottom portion 120, the top portions extending further into the work area than the bottom portions. Arranged in this manner, dividers 116 more effectively centrally contain fumes generated within the work area and aid in preventing the spread of toxic fumes throughout the entire work area by promoting laminar flow across the area. Dividers 116 also segregate contaminated air from the cleaner air as it forms the vortex roll within the hood and minimize the impact of room activity on the containment efficiency of the hood.

To decrease the effective surface area of the sash opening, cabinet 12 may contain air regulating side shields 122 as best seen in FIGS. 1 and 7. Side shields 122 extend from vertical side walls 20,22 into the work area and are preferably angled toward front face 16 at approximately 45°, without obstructing the path of sash 28. Side shields 122 are sufficiently spaced from vertical side walls 20, 22 to permit the flow of air therebetween. Further, side shields 122 contain a plurality of apertures 123 therein through which air may flow. When arranged in this manner, side shields 122 reduce the effective surface area of the opening in front face 16 yet do not completely obstruct the flow of air in the area of the shields. The shields 122 may be removable or hinged to swing out of the way so the full area of the hood may be utilized if desired.

Another feature of fume hood 10 is a channel-containing floor 124 shown in cross-section in FIG. 9. Floor 124 has a substantially planar bottom surface 126 and contains a series of protrusions 128 on the top surface. The bottom surface 126 is adjacent the interior surface 130 of bottom face 26, thus protrusions 128 extend upwardly into the work area to form a work platform. The area between protrusions 128 form a series of U-shaped channels 132. Channels 132 are oriented in substantially parallel relation to vertical side walls 20, 22. In operation, air flow along bottom face 26 flows toward baffle 36 through channels 132, which allows the air to freely flow under obstacles such as laboratory equipment. Preferably, floor 124 is removable. As such, any liquids spilled during procedures being performed in hood 10 will collect in channels 132 and may be easily cleaned up by removing the floor.

Constructed and operated as previously described, this invention provides largely horizontal, laminar air flow moving through the sash opening and exhausting through the exhaust system wherein both entry and exhaust areas are of approximately equal dimension. This smooth horizontal flow of lower velocity air at all times minimizes the potential for the air to roll and for contamination to move down the interior of the sash. Thus, contaminants near the actual breathing zone of the operator are reduced. Further, the substantially laminar flow of air allows the hood to operate at lower inflow air velocities thus reducing the energy required to condition the exhausted air and reducing the load on the building HVAC system. The exhaust hood of the present invention contains better and is less susceptible to external conditions, traffic patters near the sash opening and work procedures. Further, the exhaust hood of the present invention provides the dual benefits of enhanced safety and reduced energy consumption. The addition of one or more of the optional features discussed herein increases the benefits attained by use of the hood of the present invention.

In summary, the present invention is directed to an improved laboratory fume hood. The present invention has been described in relation to particular embodiments which are intended in all respects to be illustrative rather than restrictive. Alternative embodiments will become apparent to those skilled in the art to which the present invention pertains without departing from its scope.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Having thus described the invention, what is claimed is:

1. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone; and a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area, wherein each of said first and second structures includes a plurality of apertures therein, each said aperture having an area, wherein the sum of the areas of all apertures in said first structure is greater than the sum of the areas of all apertures in said second structure.

2. An exhaust hood as recited in claim 1, further comprising a horizontal elongated opening located beneath said baffle.

3. An exhaust hood as recited in claim 2, wherein said plenum is further defined by a solid intermediate wall, said wall being located between said baffle and said rear face, wherein each of said wall and said baffle has a vertical length.

4. An exhaust hood as recited in claim 3, wherein said wall is coupled with said baffle above the midpoint of said baffle.

5. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area; and a horizontal elongated opening located beneath said baffle, wherein said plenum is further defined by a perforated intermediate wall, said wall being located between said baffle and said rear face.

6. An exhaust hood as recited in claim 4, wherein said wall is coupled with said baffle at above the midpoint of the baffle and at the vicinity of the lower end thereof.

7. An exhaust hood as recited in claim 1, wherein said sash is movable between a first position, wherein said opening in said front face of said cabinet is substantially closed to air flow, a second position substantially corresponding to said first height and to said first plenum zone, wherein said opening is partially open to air flow, and a third position substantially corresponding to said second height and to said second plenum zone wherein said opening has a greater area than when said sash is in said second position.

8. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area;

a horizontal elongated opening located beneath said baffle, wherein said cabinet includes a top face, said top face including an intake for supplying dilution air across the interior face of said sash; and a perforated intake air guide in the area of said intake, wherein said guide directs a portion of the air passing through said intake along said interior face of said sash and a portion of the air passing through said intake into an upper portion of said work area.

9. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area; and a horizontal elongated opening located beneath said baffle, wherein said cabinet has a top face, said top face including apertures on at least a portion thereof for supplying dilution air across said interior face of said sash.

10. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area;

a horizontal elongated opening located beneath said baffle; and first and second vertical dividers spaced from one another and extending outwardly from said baffle and into said work area.

11. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area; and a horizontal elongated opening located beneath said baffle, wherein said cabinet further includes two opposing vertical side faces extending between said front face and said rear face and being substantially perpendicular thereto, and wherein said exhaust hood further comprises first and second perforated side shields, one extending angularly between each said side face and said interior face of said sash, thereby blocking a portion of the air entering through said opening.

12. An exhaust hood as recited in claim 11, wherein said cabinet further includes a bottom surface, said surface having a plurality of elongated channels therein, each said channel being substantially U-shaped and substantially parallel to each said vertical side face.

13. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone; and a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure.

14. An exhaust hood as recited in claim 13, whereby when said sash is raised to said second height, air entering said lower portion of said opening flows primarily across said work area and into said first structure, air entering said intermediate portion of said opening flows primarily across said work area and into said third structure and air entering said upper portion of said opening flows primarily across said work area and into said second structure, thereby resulting in substantially laminar flow of air through said work area.

15. An exhaust hood as recited in claim 13, wherein each of said first, second and third structures includes a plurality of apertures therein, each said aperture having an area, wherein the sum of the areas of all apertures in said first structure is greater than the sum of the areas of all apertures in said third structure and the sum of the areas of all apertures in said third structure is greater than the sum of the areas of all apertures in said second structure.

16. An exhaust hood as recited in claim 13, wherein said plenum is further defined by a solid intermediate wall, said wall being located between said baffle and said rear face.

17. An exhaust hood as recited in claim 16, wherein said wall is coupled with said baffle above the midpoint of the baffle.

18. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area; and a horizontal elongated opening located beneath said baffle, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure, and wherein said plenum is further defined by a perforated intermediate wall, said wall being located between said baffle and said rear face.

19. An exhaust hood as recited in claim 18, wherein said wall is coupled with said baffle above the midpoint of said baffle and at the vicinity of the end thereof.

20. An exhaust hood as recited in claim 13, wherein said sash is movable between a first position, wherein said opening in said front face of said cabinet is substantially closed to air flow, a second position substantially corresponding to said first height and to said first plenum zone, wherein said opening is partially open to air flow, a third position substantially corresponding to said third height and to said third plenum zone, wherein said opening has a greater area than when said sash is in said second position, and a fourth position substantially corresponding to said second height and to said second plenum zone, wherein said opening has a greater area than when said sash is in said third position.

21. An exhaust hood as recited in claim 13, wherein said cabinet includes a top face, said top face including an intake for supplying dilution air across said interior face of said sash.

22. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area;

a horizontal elongated opening located beneath said baffle, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure, wherein said cabinet includes a top face, said top face including an intake for supplying dilution air across said interior face of said sash; and a perforated intake air guide in the area of said intake, wherein a portion of the air which enters said intake is directed along said interior face of said sash and a portion of the air which enters said intake is directed into an upper portion of said work area.

23. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area; and a horizontal elongated opening located beneath said baffle, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure, and wherein said cabinet has a top face, said top face including apertures on at least a portion thereof for supplying dilution air across the interior face of said sash.

24. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area;

a horizontal elongated opening located beneath said baffle, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure; and first and second vertical dividers spaced from one another and extending outwardly from said baffle and into said work area.

25. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area; and a horizontal elongated opening located beneath said baffle, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure, and wherein said cabinet further includes two opposing vertical side faces extending between said front face and said rear face and being substantially perpendicular thereto, and wherein said exhaust hood further comprises first and second perforated side shields, one extending angularly between each said vertical side face and said interior face of said sash, thereby blocking a portion of the air entering through said opening.

26. An exhaust hood as recited in claim 25, wherein said cabinet further includes a bottom surface, said surface having a plurality of elongated channels therein, each said channel being substantially U-shaped and substantially parallel to each said vertical side face.

27. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone; and a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area, wherein said exhaust plenum includes an upper baffle plenum section coupled with said exhaust outlet and a lower baffle plenum section independently coupled with said exhaust outlet, wherein said upper baffle plenum section is located above said lower baffle plenum section.

28. An exhaust hood as recited in claim 27, wherein said upper baffle plenum section may include a first damper coupled therewith for controlling the amount of air exhausted from said upper baffle plenum section, and wherein said lower baffle plenum section includes a second damper coupled therewith for controlling the amount of air exhausted from said lower baffle plenum section.

29. An exhaust hood as recited in claim 27, wherein said sash is movable between a first position, wherein said opening in said front face of said cabinet is substantially closed to air flow, a second position substantially corresponding to said first height and to said first plenum zone, wherein said opening is partially open to air flow, and a third position substantially corresponding to said second height and to said second plenum zone, wherein said opening has a greater area than when said sash is in said second position.

30. An exhaust hood as recited in claim 27, wherein said cabinet includes a top face, said top face including an intake for supplying dilution air across the interior face of said sash.

31. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area, wherein said exhaust plenum includes an upper baffle plenum section coupled with said exhaust outlet and a lower baffle plenum section independently coupled with said exhaust outlet, wherein said upper baffle plenum section is located above said lower baffle plenum section, wherein said cabinet includes a top face, said top face including an intake for supplying dilution air across the interior face of said sash; and a perforated intake air guide in the area of said intake, wherein a portion of the air which enters said intake is directed along said interior face of said sash and a portion of the air which enters said intake is directed into an upper portion of said work area.

32. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone; and a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area, wherein said exhaust plenum includes an upper baffle plenum section coupled with said exhaust outlet and a lower baffle plenum section independently coupled with said exhaust outlet, wherein said upper baffle plenum section is located above said lower baffle plenum section, wherein said cabinet has a top face, said top face including perforations on at least a portion thereof for supplying dilution air across said interior face of said sash.

33. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone, a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area, wherein said exhaust plenum includes an upper baffle plenum section coupled with said exhaust outlet and a lower baffle plenum section independently coupled with said exhaust outlet, wherein said upper baffle plenum section is located above said lower baffle plenum section; and first and second vertical dividers spaced from one another and extending outwardly from said baffle and into said work area.

34. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone; and a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area, wherein said exhaust plenum includes an upper baffle plenum section coupled with said exhaust outlet and a lower baffle plenum section independently coupled with said exhaust outlet, wherein said upper baffle plenum section is located above said lower baffle plenum section, wherein said cabinet further includes two opposing vertical side faces extending between said front face and said rear face and being substantially perpendicular thereto, and wherein said exhaust hood further comprises first and second perforated side shields, one extending angularly between each said vertical side face and said interior face of said sash, thereby blocking a portion of the air entering through said opening.

35. An exhaust hood as recited in claim 34, wherein said cabinet further includes a bottom surface, said surface having a plurality of elongated channels therein, each said channel being substantially U-shaped and substantially parallel to each said vertical side face.

36. An exhaust hood as recited in claim 13, wherein said exhaust plenum includes an upper baffle plenum section coupled with said exhaust outlet and a lower baffle plenum section independently coupled with said exhaust outlet, wherein said upper baffle plenum section is located above said lower baffle plenum section.

37. An exhaust hood as recited in claim 36, wherein said upper baffle plenum section includes a first damper coupled therewith for controlling the amount of air exhausted from said upper baffle plenum section, and wherein said lower baffle plenum section includes a second damper coupled therewith for controlling the amount of air exhausted from said lower baffle plenum section.

38. An exhaust hood as recited in claim 37, wherein said sash is movable between a first position, wherein said opening in said front face of said cabinet is substantially closed to air flow, a second position substantially corresponding to said first height and to said first plenum zone, wherein said opening is partially open to air flow, a third position substantially corresponding to said third height and to said third plenum zone, wherein said opening has a greater area than when said sash is in said second position, and a fourth position substantially corresponding to said second height and to said second plenum zone, wherein said opening has a greater area than when said sash is in said third position.

39. An exhaust hood as recited in claim 37, wherein said cabinet includes a top face, said top face including an intake for supplying dilution air across the interior face of said sash.

40. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area;

a horizontal elongated opening located beneath said baffle, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure, and wherein said exhaust plenum includes an upper baffle plenum section coupled with said exhaust outlet and a lower baffle plenum section independently coupled with said exhaust outlet, wherein said upper baffle plenum section is located above said lower baffle plenum section, wherein said upper baffle plenum section includes a first damper coupled therewith for controlling the amount of air exhausted from said upper baffle plenum section, and wherein said lower baffle plenum section includes a second damper coupled therewith for controlling the amount of air exhausted from said lower baffle plenum section, wherein said cabinet includes a top face, said top face including an intake for supplying dilution air across the interior face of said sash; and a perforated intake air guide in the area of said intake, wherein a portion of the air which enters said intake is directed along said interior face of said sash and a portion of the air which enters said intake is directed into an upper portion of said work area.

41. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area; and a horizontal elongated opening located beneath said baffle, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure, and wherein said exhaust plenum includes an upper baffle plenum section coupled with said exhaust outlet and a lower baffle plenum section independently coupled with said exhaust outlet, wherein said upper baffle plenum section is located above said lower baffle plenum section, wherein said upper baffle plenum section includes a first damper coupled therewith for controlling the amount of air exhausted from said upper baffle plenum section, and wherein said lower baffle plenum section includes a second damper coupled therewith for controlling the amount of air exhausted from said lower baffle plenum section, and wherein said cabinet has a top face, said top face including apertures on at least a portion thereof for supplying dilution air across the interior face of said sash.

42. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area;

a horizontal elongated opening located beneath said baffle, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure, and wherein said exhaust plenum includes an upper baffle plenum section coupled with said exhaust outlet and a lower baffle plenum section independently coupled with said exhaust outlet, wherein said upper baffle plenum section is located above said lower baffle plenum section, wherein said upper baffle plenum section includes a first damper coupled therewith for controlling the amount of air exhausted from said upper baffle plenum section, and wherein said lower baffle plenum section includes a second damper coupled therewith for controlling the amount of air exhausted from said lower baffle plenum section; and first and second vertical dividers spaced from one another and extending outwardly from said baffle and into said work area.

43. An exhaust hood comprising:

a cabinet defining a work area, said cabinet having a front face and a rear face, said front face having an opening for providing access to said work area;

an exhaust plenum located at said rear face of said cabinet which receives air passing through said work area from said opening, said plenum being coupled with an exhaust outlet, and including a baffle located in front of said rear face and having first structure located at a first plenum zone and second structure located at a second plenum zone, said first zone being located below said second zone, wherein air passing through a lower portion of said opening primarily enters said plenum through said first zone and air passing through an upper portion of said opening primarily enters said plenum through said second zone;

a vertically mounted sash for closing said opening, said sash having an exterior face and an interior face, said interior face being positioned toward said work area, whereby when said sash is raised to a first height air flows primarily across said work area and into said first structure and when said sash is raised to a second height air entering said lower portion of said opening flows primarily across said work area and into said first structure and air entering said upper portion of said opening flows primarily across said work area and into said second structure, thereby resulting in substantially laminar flow of air through said work area; and a horizontal elongated opening located beneath said baffle, wherein said baffle further includes third structure located at a third plenum zone, said third zone being located between said first and second zones, wherein air passing through an intermediate portion of said opening primarily enters said plenum through said third zone, and whereby when said sash is raised to a third height, air entering said intermediate portion of said opening primarily flows across said work area and into said third structure, and wherein said exhaust plenum includes an upper baffle plenum section coupled with said exhaust outlet and a lower baffle plenum section independently coupled with said exhaust outlet, wherein said upper baffle plenum section is located above said lower baffle plenum section, wherein said upper baffle plenum section includes a first damper coupled therewith for controlling the amount of air exhausted from said upper baffle plenum section, and wherein said lower baffle plenum section includes a second damper coupled therewith for controlling the amount of air exhausted from said lower baffle plenum section, wherein said cabinet further includes two opposing vertical side faces extending between said front face and said rear face and being substantially perpendicular thereto, and wherein said exhaust hood further comprises first and second perforated side shields, one extending angularly between each said vertical side face and said interior face of said sash, thereby blocking a portion of the air entering through said opening.

44. An exhaust hood as recited in claim 43, wherein said cabinet further includes a bottom surface, said surface having a plurality of elongated channels therein, each said channel being substantially U-shaped and substantially parallel to each said vertical side face.

45. A handle for use with an exhaust hood sash, said handle being located beneath said sash and being spaced therefrom, thereby permitting the passage of air between said sash and said handle, said handle comprising:

a perforated rear plate having an upper edge and a lower edge;

an upper arm portion extending outwardly and upwardly from said upper edge; and a lower arm portion extending outwardly and upwardly from said lower edge, thereby forming a channel between said lower arm portion and said rear plate, wherein air passes through said channel.

46. An air foil for use with an exhaust hood, said exhaust hood comprising a cabinet defining a work area and having a front face, a rear face and a bottom surface, wherein said bottom surface extends between and is substantially perpendicular to said front and rear faces, and wherein said bottom surface includes a forward edge in the area of said front face, said front face having an opening for providing access to said work area, said air foil comprising:

a curved plate having a front edge and a rear edge, said front edge located in the area of said forward edge of said bottom surface, wherein said plate extends into said work area and terminates in said rear edge, said rear edge being spaced from said bottom surface, and wherein said plate includes a plurality of apertures through at least a portion thereof, thereby allowing air to flow across said work area and across the top surface of the plate by entering through said apertures and exiting between said rear edge of said plate and said bottom surface.

47. An air foil as recited in claim 46, wherein said front edge of said plate extends beyond said forward curved edge of said bottom surface in a direction away from said work area.

48. An air stabilizing device for use with an exhaust hood cabinet, said cabinet defining a work area and having a front face and a rear face, said front face having an opening for providing access to said work area, said device comprising:

first and second dividers spaced from one another and extending outwardly from said rear face and into said work area, thereby permitting the containment of air between said dividers.

49. An air stabilizing device as recited in claim 48, wherein each said divider includes a top section and a bottom section, and wherein each said top section extends further into said work area than each said bottom section.

50. An air flow regulating device for use with an exhaust hood, said exhaust hood comprising a cabinet defining a work area and having a front face, a rear face and first and second opposing vertical side faces, said side faces extending between said front and rear faces and being substantially perpendicular thereto, said front face having an opening therein for providing access to said work area and permitting air to enter therethrough, said device comprising:

a first perforated side shield extending angularly between said first vertical side face and said front face, thereby blocking a portion of the air entering through said opening.

51. An air flow regulating device as recited in claim 50, further comprising a second perforated side shield extending angularly between said second vertical side face and said front face, thereby blocking a portion of the air entering through said opening.

52. A floor for use with an exhaust hood, said hood comprising a cabinet defining a work area and having a front face, a rear face, two opposing vertical side faces and a bottom surface, wherein said bottom surface extends between said front and rear faces and is substantially perpendicular to each, and wherein said bottom surface extends between said vertical side faces and is substantially perpendicular to each, said floor comprising:

a plate having a top face and a bottom face, wherein said bottom face is substantially planar, wherein said top face includes a plurality of elongated channels therein, each said channel being substantially U-shaped and being substantially parallel to each said vertical side face, and wherein when said plate is in use, said bottom face of said plate is adjacent said bottom surface of said cabinet.

53. A floor as recited in claim 52, wherein said floor is removable.

54. An exhaust hood comprising:

a cabinet defining a generally horizontally extending work area, said cabinet having upwardly extending, horizontally spaced apart front and rear walls, said work area being located between said walls, said front wall having an opening therein providing access to said work area;

baffle structure disposed between said rear wall of said cabinet and the work area, said structure and said rear wall defining an exhaust plenum located in a position to receive air passing through said work area from said opening, said plenum being coupled in fluid communication with an exhaust outlet, said baffle structure including a generally upwardly extending baffle and a generally upwardly extending intermediate wall located between said baffle and said rear wall, said baffle and said intermediate wall being joined together in a manner to prevent upward flow of air therebetween; and a vertically moveable sash mounted adjacent said front wall for selectively opening and closing said opening, said cabinet, said opening, said structure and said sash being adapted and arranged to promote a substantially laminar flow of air through said work area.

55. An exhaust hood comprising:

a cabinet defining a generally horizontally extending work area, said cabinet having upwardly extending, horizontally spaced apart front and rear walls, said work area being located between said walls, said front wall having an opening therein providing access to said work area;

baffle structure disposed between said rear wall of said cabinet and the work area, said structure, said structure and said rear wall defining an exhaust plenum located in a position to receive air passing through said work area from said opening, said plenum being coupled in fluid communication with an exhaust outlet, said baffle structure including a generally upwardly extending baffle and a generally upwardly extending, perforated intermediate wall located between said baffle and said rear wall; and a vertically moveable sash mounted adjacent said front wall for selectively opening and closing said opening, said cabinet, said opening, said structure and said sash being adapted and arranged to promote a substantially laminar flow of air through said work area.

56. An exhaust hood comprising:

a cabinet defining a generally horizontally extending work area, said cabinet having upwardly extending, horizontally spaced apart front and rear walls and an upper wall joining said front and rear walls, said work area being located between said front and rear walls and beneath said upper wall, said front wall having an opening therein providing access to said work area;

a vertically moveable sash mounted adjacent said front wall for selectively opening and closing said opening in the front wall, said upper wall having an intake opening therein positioned to direct a flow of dilution air across an interior face of said sash; and a perforated intake air guide in the area of said intake opening directing a portion of the dilution air passing through said intake opening along said interior face of the sash and another portion of the dilution air passing through said intake opening into an upper portion of said work area.

57. An exhaust hood comprising:

a cabinet defining a generally horizontally extending work area, said cabinet having upwardly extending, horizontally spaced apart front and rear walls and an upper wall joining said front and rear walls, said work area being located between said front and rear walls and beneath said upper wall, said front wall having an opening therein providing access to said work area; and a vertically moveable sash mounted adjacent said front wall for selectively opening and closing said opening in the front wall, said upper wall having a plurality of apertures therein positioned to direct a flow of dilution air across an interior face of said sash.

58. An exhaust hood comprising:

a cabinet defining a generally horizontally extending work area, said cabinet having upwardly extending, horizontally spaced apart front and rear walls, said work area being located between said front and rear walls, said front wall having an opening therein providing access to said work area; and divider structure including at least one upwardly extending divider, said at least one divider extending in a direction away from said rear wall and into said work area.

59. An exhaust hood as set forth in claim 58, wherein said divider structure includes at least two laterally spaced apart dividers.

60. An exhaust hood comprising:

a cabinet defining a generally horizontally extending work area, said cabinet having upwardly extending, horizontally spaced apart front and rear walls and a pair of opposed, upwardly extending, horizontally spaced apart side walls, said side walls extending between said front and rear walls, said work area being located between said front and rear walls and between said side walls, said front wall having an opening therein providing access to said work area;

a vertically moveable sash mounted adjacent said front wall for selectively opening and closing said opening in the front wall; and an upwardly extending, perforated side shield extending angularly from a first one of said side walls and toward an interior face of said sash in a position to block a portion of any air entering into the cabinet through said opening in the front wall.

61. An exhaust hood as set forth in claim 60, comprising a second upwardly extending, perforated side shield extending angularly from a second one of said side walls and toward an interior face of said sash in a position to block a portion of any air entering into the cabinet through said opening in the front wall.

62. An exhaust hood comprising:

a cabinet defining a generally horizontally extending work area, said cabinet having upwardly extending, horizontally spaced apart front and rear walls and a bottom wall extending between the front and rear walls, said work area being located between said front and rear walls and above said bottom wall, said front wall having an opening therein providing access to said work area; and structure on an upper surface of said bottom wall defining a plurality of elongated, substantially U-shaped channels extending in a direction between said front wall and said rear wall.

63. An exhaust hood as set forth in claim 62, wherein said structure on said upper surface of the bottom wall is removable from said cabinet.

64. An exhaust hood as set forth in claim 56, 57, 58, 59, 60, 61, 62 or 63, further comprising baffle structure disposed between said rear wall of said cabinet and the work area, said structure and said rear wall defining an exhaust plenum located in a position to receive air passing through said work area from said opening, said plenum being coupled in fluid communication with an exhaust outlet, said baffle structure being adapted and arranged to promote a substantially laminar flow of air through said work area in concert with the other components of the exhaust hood.

65. An exhaust hood comprising:

a cabinet defining a generally horizontally extending work area, said cabinet having upwardly extending, horizontally spaced apart front and rear walls, said work area being located between said walls, said front wall having an opening therein providing access to said work area;

baffle structure spaced from said rear wall and disposed between the latter and the work area, said baffle structure and said rear wall defining an exhaust plenum located in a position therebetween to receive air passing through said work area from said opening, said baffle structure including a first plenum structure located adjacent a first plenum zone in said plenum, a second plenum structure located adjacent a second plenum zone in said plenum, and a third plenum structure located adjacent a third plenum zone in said plenum, said first zone being located below said second zone and said third zone being located above said second zone, whereby air passing through a lower portion of said opening primarily enters said first plenum zone through said first plenum structure, air passing through a central portion of said opening primarily enters said second plenum zone through said second plenum structure and air passing through an upper portion of said opening primarily enters said third plenum zone through said third plenum structure; and a vertically moveable sash mounted adjacent said front wall for selectively opening and closing said opening, said sash being selectively positionable at a first height with a lower edge thereof positioned at an upper region of the lower portion of the opening, a second height with a lower edge thereof positioned at an upper region of the central portion of the opening, and a third height with a lower edge thereof positioned at an upper region of the upper portion of the opening, whereby air flowing through said opening flows primarily into said first plenum zone when said sash is raised to said first height, air flowing through said opening flows primarily into said first and second plenum zones when said sash is raised to said second height, and air flowing through said opening flows primarily into all three of said plenum zones when said sash is raised to said third height, whereby to promote substantially laminar air flow through said work area.

66. An exhaust hood as set forth in claim 65, wherein said baffle structure is positioned such that a generally horizontal, elongated opening in communication with said plenum is presented therebeneath.

67. An exhaust hood as set forth in claim 65, wherein each of said first, second and third structures includes a plurality of apertures therein accommodating the flow of air into the respective corresponding plenum zones, each said aperture having an open area, wherein the total open area of the apertures in the first structure is greater than the total open area of the apertures in the second structure, and the total open area of the apertures in the second structure is greater than the total open area of the apertures in the third structure.

68. An exhaust hood comprising:

a cabinet defining a generally horizontally extending work area, said cabinet having upwardly extending, horizontally spaced apart front and rear walls, said work area being located between said walls, said front wall having an opening therein providing access to said work area;

baffle structure spaced from said rear wall and disposed between the latter and the work area, said baffle structure and said rear wall defining an exhaust plenum located in a position therebetween to receive air passing through said work area from said opening, said baffle structure including a first plenum structure located adjacent a first plenum zone in said plenum and a second plenum structure located adjacent a second plenum zone in said plenum, said first zone being located below said second zone, whereby air passing through a lower portion of said opening primarily enters said first plenum zone through said first plenum structure and air passing through a portion of said opening above said lower portion primarily enters said second plenum zone through said second plenum structure; and a vertically moveable sash mounted adjacent said front wall for selectively opening and closing said opening, said sash being selectively positionable at a first height with a lower edge thereof positioned at an upper region of the lower portion of the opening and a second height with a lower edge thereof positioned at an upper region of the central portion of the opening, whereby air flowing through said opening flows primarily into said first plenum zone when said sash is raised to said first height and air flowing through said opening flows primarily into said first and second plenum zones when said sash is raised to said second height, wherein each of said first and, second structures includes a plurality of apertures therein accommodating the flow of air into the respective corresponding plenum zones, each said aperture having an open area, wherein the total open area of the apertures in the first structure is greater than the total open area of the apertures in the second structure, whereby to promote substantially laminar air flow through said work area.

69. An exhaust hood as set forth in claim 68, wherein said baffle structure is positioned such that a generally horizontal, elongated opening in communication with said plenum is presented therebeneath.

* * * * *

UNITED STATES PATENT AND TRADEMARK OFFICE

CERTIFICATE OF CORRECTION

PATENT NO. : 6,461,233 B1
DATED : October 8, 2002
INVENTOR(S) : Gilkison et al.

It is certified that error appears in the above-identified patent and that said Letters Patent is hereby corrected as shown below:

Column 16,
Line 4, delete "4" and insert -- 5 -- therefor.

Signed and Sealed this

Fifteenth Day of July, 2003

JAMES E. ROGAN
*Director of the United States Patent and Trademark Office*